US010349708B1

(12) United States Patent
Mak et al.

(10) Patent No.: US 10,349,708 B1
(45) Date of Patent: Jul. 16, 2019

(54) TRACK ZIPPER AND CONNECTING STRUCTURE WITH A TRACK ZIPPER

(71) Applicant: Ka Yin Yik, Hong Kong (HK)

(72) Inventors: Chi Yin Mak, Hong Kong (HK); Ka Yin Yik, Hong Kong (HK)

(73) Assignee: Ka Yin Yak, Hong Kong (HK)

( * ) Notice: Subject to any disclaimer, the term of this patent is extended or adjusted under 35 U.S.C. 154(b) by 0 days.

(21) Appl. No.: 15/957,997

(22) Filed: Apr. 20, 2018

(30) Foreign Application Priority Data

Feb. 15, 2018 (CN) ..... 2018 1 0152491

(51) Int. Cl.

| | |
|---|---|
| ***A44B 19/20*** | (2006.01) |
| ***A44B 19/26*** | (2006.01) |
| ***B65D 63/10*** | (2006.01) |
| ***E05D 7/00*** | (2006.01) |
| ***B65D 33/25*** | (2006.01) |
| ***E05D 7/10*** | (2006.01) |

(52) U.S. Cl.
CPC ..... *A44B 19/20* (2013.01); *A44B 19/262* (2013.01); *B65D 33/2591* (2013.01); *B65D 63/10* (2013.01); *E05D 7/009* (2013.01); *E05D 7/10* (2013.01); *B65D 2563/107* (2013.01); *Y10T 24/26* (2015.01)

(58) Field of Classification Search
CPC ..... Y10T 24/26; A44B 19/18; A44B 19/20; A44B 19/262; B65D 33/2591; B65D 63/10
USPC ..... 24/437
See application file for complete search history.

(56) References Cited

U.S. PATENT DOCUMENTS 1,734,479 A * 11/1929 Glidden ..... A44B 19/18 24/437
6,393,674 B1 * 5/2002 Dolci ..... A44B 19/20 24/399

FOREIGN PATENT DOCUMENTS

WO 02082939 A1 10/2002

* cited by examiner

*Primary Examiner* — Abigail E Troy

(57) ABSTRACT

The present disclosure relates to a track zipper and a connecting structure having a track zipper. The track zipper includes a first track, a second track, and a zipper core connecting the first and second tracks. The first track and a first side of the zipper core are provided with a first slidably connecting structure. The second track and a second side of the zipper core are provided with a second slidably connecting structure. When the track zipper is in a closed position, the zipper core is positioned between the first and second tracks and holds the first and second tracks together. The track zipper of the present disclosure is advantageous in that it can prevent foreign material from being caught by the zipper, and that it has a much stronger bearing capacity.

6 Claims, 37 Drawing Sheets

TRACK ZIPPER AND CONNECTING STRUCTURE WITH A TRACK ZIPPER

CROSS REFERENCE TO RELATED APPLICATIONS

The present application claims the benefit of Chinese Patent Application No. 201810152491.X filed on Feb. 15, 2018. All the above are hereby incorporated by reference.

TECHNICAL FIELD

The present disclosure relates to a zipper or zipper-like device, and more specifically relates to a track zipper and a connecting structure having a track zipper.

BACKGROUND

Zippers, known as one of the top ten inventions that make people's life more convenient, have more than 100 years of history. Existing zippers generally include two flexible tapes with two rows of teeth (metal teeth or plastic teeth), and a zipper head for pulling the two rows of teeth into interlocking position, thereby connecting the two flexible tapes together. Zippers can be used in clothing, bags, tents and other items. Through the function of the zipper head, the zipper can be zipped up or unzipped as needed. When the zipper head is moved upwards, the two rows of teeth on the two tapes are limited by the shape of the closure angle of the channel inside the zipper head. When the two rows of teeth are pushed towards each other, the teeth are interlocked and the zipper is closed. When the zipper head is pulled to the top of the zipper, the width of a top stop is greater than the width of the narrowest part of the inner cavity of the zipper head such that further movement of the zipper head is limited and the zipper head would not fall off. When the zipper head is pulled downwards, a pillar in the inner cavity of the zipper head having two surfaces at a splitting angle (dihedral angle) can separate the peaks and valleys of the teeth one by one, and the two tapes are separated. When the zipper head is pulled to the bottom of the zipper, the width of a bottom stop is greater than the width of a bottom opening of the zipper head, and the zipper head would not fall off. Although zippers are very convenient for people's life, they are not perfect and they have certain defects. The ingenious idea of a zipper is the formation of a hook and a recess on each tooth so that the teeth can interlock one with the other. However, this is also its weakness. In fact, as long as one of the zipper teeth fails, it can lead to failure of the entire zipper. Also, if one deliberately destroys the zipper teeth by using a sharp object such as the tip of a pen, it can pierce through the teeth, thereby causing gradual separation of the two rows of teeth of the zipper. Furthermore, if two pliers are used to clamp onto the two tapes and force is applied by the two pliers, it can separate the interlocked teeth of the zipper. The separated teeth, especially the pair of teeth closest to the closing position, usually cannot be perfectly interlocked again. As a result, the zipper head cannot pass through the damaged teeth, and the entire zipper become useless. The design of zipper is also limited by its size. When the zipper head is moved upwards, adjacent teeth need to be completely interlocked, and when the zipper head is moved downwards, the zipper head needs to separate the interlocked teeth. Furthermore, the material in some parts of the zipper is very thin, and thus the load capacity of the zipper is limited.

SUMMARY

The technical problem to be solved is to provide a track zipper that can obviate the above-mentioned defects of the existing zippers.

The technical scheme for solving the technical problem is to provide a track zipper, including a first track; a second track; and a zipper core connecting the first and second tracks; a first slidably connecting structure provided on the first track and a first side of the zipper core, the zipper core being slidable relative to the first track along a lengthwise direction thereof through the first slidably connecting structure, and the zipper core being inseparable from the first track in a direction perpendicular to the lengthwise direction of the first track; a second slidably connecting structure provided on the second track and a second side of the zipper core, the zipper core being slidable relative to the second track along a lengthwise direction thereof through the second slidably connecting structure, and the zipper core being inseparable from the second track in a direction perpendicular to the lengthwise direction of the second track; whereby when the track zipper is in a closed position, the zipper core is provided between the first and second tracks, and connects the first and second tracks together.

In an embodiment of the track zipper of the present disclosure, the first slidably connecting structure includes a first track groove formed on the first track; and a first track portion formed on the first side of the zipper core and mating with the first track groove, the first track portion being slidable in the first track groove along an extending direction thereof, and inseparable from the first track groove in a direction perpendicular to the extending direction of the first track groove.

In an embodiment of the track zipper of the present disclosure, the first slidably connecting structure includes a first track portion formed on the first track; and a first track groove formed on the first side of the zipper core and mating with the first track portion, the first track groove of the zipper core being sheathed on the first track portion, the first track groove being slidable on the first track portion along an extending direction thereof, and inseparable from the first track portion in a direction perpendicular to the extending direction of the first track portion.

In an embodiment of the track zipper of the present disclosure, the second slidably connecting structure includes a second track groove formed on the second track; and a second track portion formed on the second side of the zipper core and mating with the second track groove, the second track portion being slidable in the second track groove along an extending direction thereof, and inseparable from the second track groove in a direction perpendicular to the extending direction of the second track groove.

In an embodiment of the track zipper of the present disclosure, the second slidably connecting structure includes a second track portion formed on the second track; and a second track groove formed on the second side of the zipper core and mating with the second track portion, the second track groove of the zipper core being sheathed on the second track portion, the second track groove being slidable on the second track portion along an extending direction thereof, and inseparable from the second track portion in a direction perpendicular to the extending direction of the second track portion.

In an embodiment of the track zipper of the present disclosure, a head portion of the zipper core is provided with a handle, and the head portion of the zipper core has a guide portion which facilitates coupling of the zipper core with the first and second tracks.

In an embodiment of the track zipper of the present disclosure, the zipper core is an assembly of one or more parts which adapts to a change of angle between the first and second tracks, and the zipper core is collapsible or non-collapsible.

In an embodiment of the track zipper of the present disclosure, a first protrusion-recess structure is provided between the zipper core and the first track, and a second protrusion-recess structure is provided between the zipper core and the second track, wherein the first and second protrusion-recess structures include a plurality of protrusions and/or a plurality of recesses formed on the zipper core, and a plurality of protrusions and/or a plurality of recesses formed on the first and second tracks, whereby when the track zipper is in a closed position, the protrusions on the zipper core are inserted into the recesses on the first and second tracks, and the protrusions on the first and second tracks are inserted into the recesses of the zipper core.

In an embodiment of the track zipper of the present disclosure, the first track and/or the second track are segmental structures.

In an embodiment of the track zipper of the present disclosure, the zipper core is a segmental structure.

Furthermore, the present disclosure provides a connecting structure with a track zipper including a first object; a second object; and the above-mentioned track zipper for connecting the first and second objects, wherein the first track of the track zipper is connected with the first object, and the second track of the track zipper is connected with the second object.

In an embodiment of the connecting structure with a track zipper of the present disclosure, the first object and the second object are respectively two sides of an opening of a plastic bag.

In an embodiment of the connecting structure with a track zipper of the present disclosure, the first object and the second object are respectively two objects to be sewn together.

In an embodiment of the connecting structure with a track zipper of the present disclosure, the first and second objects are respectively a first package panel and a second package panel of a group of packaging items.

In an embodiment of the connecting structure with a track zipper of the present disclosure, the first object is a frame body, and the second object is a door or a cover, wherein a side of the frame body and a side of the door or the cover are connected by a hinge, the first track is provided on remaining sides of the frame body, and the second track is provided on remaining sides of the door or the cover, and wherein the zipper core is bendable, and the door or the cover is secured on the frame body when the track zipper is in a closed position.

In an embodiment of the connecting structure with a track zipper of the present disclosure, the connecting structure includes a plurality of track zippers.

In an embodiment of the connecting structure with a track zipper of the present disclosure, the first object penetrates into the second object and abuts against the second object, and the first and second objects are secured together when the track zipper is closed.

In an embodiment of the connecting structure with a track zipper of the present disclosure, the first and second objects are respectively a first panel and a second panel of a piece of furniture, the furniture being foldable or non-foldable, wherein the first panel and the second panel are secured together when the track zipper is in a closed position.

In an embodiment of the connecting structure with a track zipper of the present disclosure, the first object and the second object are folded up to hold a third object, and the first object and the second object are in a fold up position when the track zipper is closed.

In an embodiment of the connecting structure with a track zipper of the present disclosure, the first object and the second object are parts of a device for adjusting the opening angle of a window.

In an embodiment of the connecting structure with a track zipper of the present disclosure, the first object and the second object are a casing of a reusable cable tie, and the third object is the cable tie.

The track zipper of the present disclosure has the following beneficial effects. Since the track zipper of the present disclosure is provided with a zipper core slidable between a first track and a second track, and connecting the first track and the second track together, it can overcome the disadvantage of the existing zippers which can have foreign material easily caught by the teeth of the zipper and can lead to failure of the entire zipper due to damage of a few teeth of the zipper. In addition, the track zipper of the present disclosure has a much stronger bearing capacity, and therefore it cannot be easily damaged or pulled apart even by a strong force.

BRIEF DESCRIPTION OF THE DRAWINGS

The present disclosure will be further explained in conjunction with embodiments and the following drawings in which.

DETAILED DESCRIPTION

Figure 1A:
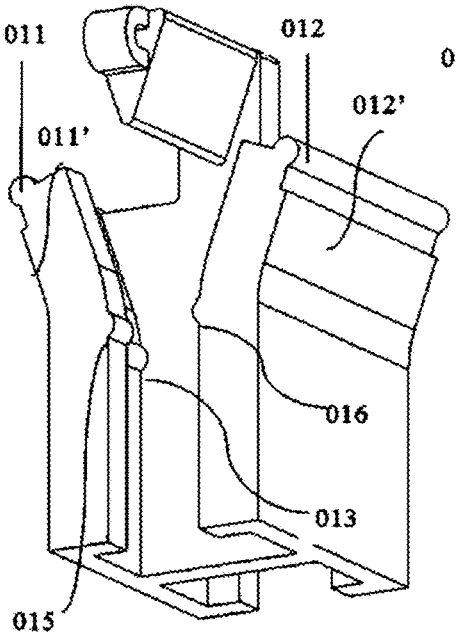
FIG. 1*a* is a schematic diagram of a zipper core according to an embodiment of the track zipper of the present disclosure.
Figure 1B:
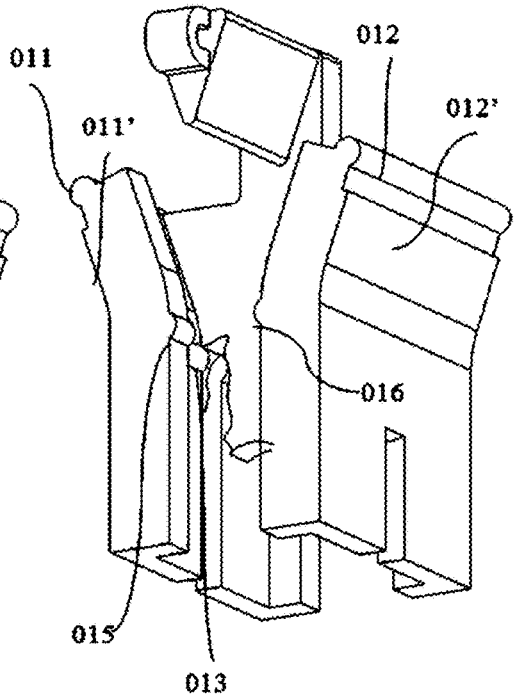
FIG. 1*b* is a schematic cutaway diagram of the zipper core as shown in FIG. 1*a;*
Figure 1C:
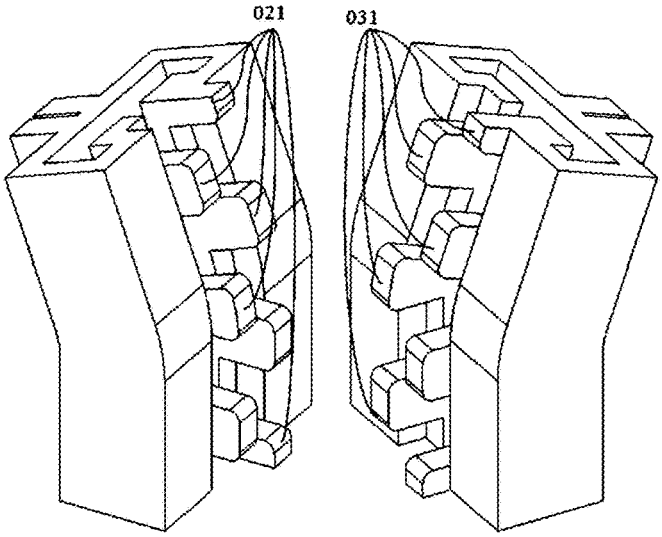
FIG. 1*c* is a schematic diagram of the first and second tracks according to an embodiment of the track zipper of the present disclosure.
Figure 1D:
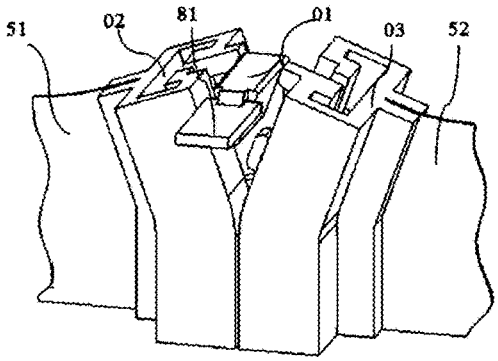
FIG. 1*d* is a schematic diagram of the zipper core coupling with the first track and the second track according to an embodiment of the track zipper of the present disclosure.
Figure 1E:
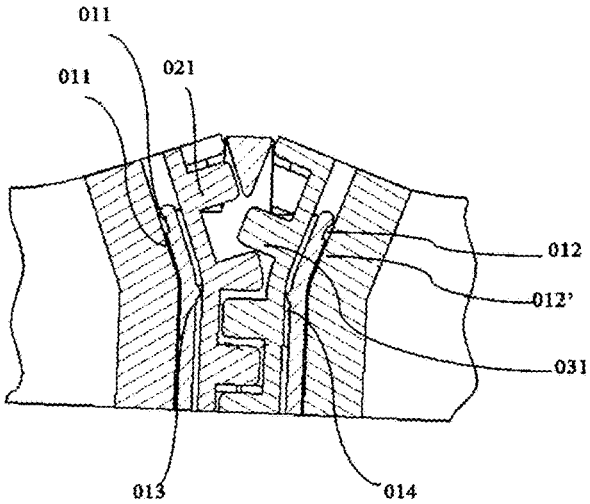
FIG. 1*e* is a cross-sectional view of the track zipper shown in FIG. 1*d;*
Figure 1F:
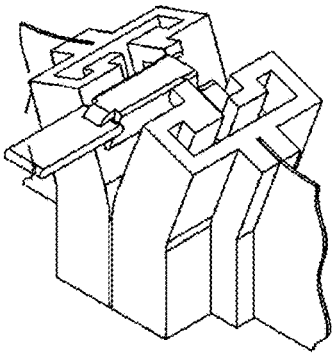
FIG. 1*f* is another schematic diagram in which the zipper core is coupled with the first track and the second track according to an embodiment of the track zipper of the present disclosure.
Figure 1G:
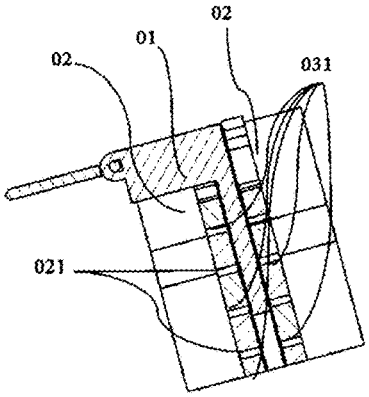
FIG. 1*g* is a cross-sectional view of the track zipper shown in FIG. 1*f;*
Figure 1H:
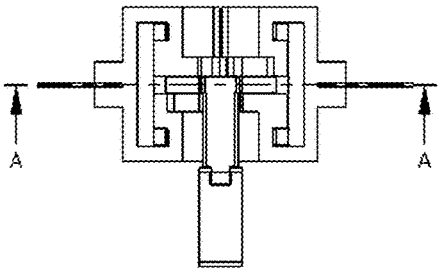
FIG. 1*h* is a top view of an embodiment of the track zipper of the present disclosure.

In order to have a clearer understanding of the technical characteristics, purposes and effects of the present disclosure, specific embodiments of the present disclosure are described in detail with the drawings.

The following is a detailed description of the track zipper of the present disclosure and some embodiments of the connecting structure with the track zipper, embodiments of which are shown in the drawings where the same or similar markings throughout the drawings represent the same or similar components, or components that have the same or similar functions.

In the description of the track zipper and the connecting structure with the track zipper of the present disclosure, it is understood that the orientation or position of the terms such as "front", "rear", "top", "bottom", "upper end", "lower end", "upper portion", "lower portion", etc., is based on the position or direction indicated in the drawings. They are used to describe the present disclosure and simplify the description only. They are not used to indicate or imply that the device or element must have a specific orientation, or it is constructed and operated in a particular direction. It is understood that these terms are not a restriction on the present disclosure. In addition, the term "first" and "second" are used only for descriptive purposes and cannot be understood as an indication or implication of its relative importance.

The track-type zipper provided by the present disclosure may include a first track, a second track, and a zipper core connecting the first and second tracks. The length of the zipper core may be equal to or less than the length of the first track and the second track. A first slidably connecting structure may be provided on the first track and a first side of the zipper core. The zipper core can be slidable relative to the first track along a lengthwise direction thereof through the first slidably connecting structure. The zipper core is inseparable from the first track in a direction perpendicular to the lengthwise direction of the first track. A second slidably connecting structure may be provided on the second track and a second side of the zipper core. The zipper core can be slidable relative to the second track along a lengthwise direction thereof through the second slidably connecting structure. The zipper core is inseparable from the second track in a direction perpendicular to the lengthwise direction of the second track. When the track zipper is in a closed position, the zipper core is provided between the first and second tracks, and connects the first and second tracks together. When the track zipper is in an open position, the zipper core can cooperate with the first track, thus attaching to the first track, or the zipper core can cooperate with the second track, thus attaching to the second track. Of course the zipper core can also be rolled up. The first slidably connecting structure and the second slidably connecting structure, in general, can be summed up as mating track portion and track groove. The track portion can slide in the track groove along the lengthwise direction of the track groove, but the track portion cannot be separated from the track groove in the direction perpendicular to the lengthwise direction of the track groove, so that when the track zipper is closed, the zipper core can connect the first and second tracks together. When the track zipper is opened, the zipper core may be attached to the first track or the second track, and the zipper core can be rolled up.

In the track zipper of the present disclosure, the first slidably connecting structure may include a first track groove formed on the first track, and a first track portion formed on the first side of the zipper core and mating with the first track groove. The first track portion can be slidable in the first track groove along an extending direction thereof, and the first track portion is inseparable from the first track groove in a direction perpendicular to the extending direction of the first track groove. Alternatively, the first slidably connecting structure may include a first track portion formed on the first track, and a first track groove formed on the first side of the zipper core and mating with the first track portion. The first track groove of the zipper core may be sheathed on the first track portion. The first track groove can be slidable on the first track portion along an extending direction thereof, and the first track groove is inseparable from the first track portion in a direction perpendicular to the extending direction of the first track portion.

In the track zipper of the present disclosure, the second slidably connecting structure may include a second track groove formed on the second track, and a second track portion formed on the second side of the zipper core and mating with the second track groove. The second track portion can be slidable in the second track groove along an extending direction thereof, and the second track portion is inseparable from the second track groove in a direction perpendicular to the extending direction of the second track groove. Alternatively, the second slidably connecting structure may include a second track portion formed on the second track, and a second track groove formed on the second side of the zipper core and mating with the second track portion. The second track groove of the zipper core may be sheathed on the second track portion. The second track groove can be slidable on the second track portion along an extending direction thereof, and the second track groove is inseparable from the second track portion in a direction perpendicular to the extending direction of the second track portion.

Since the track zipper of the present disclosure is provided with a zipper core slidable between a first track and a second track, and connecting the first track and the second track together, it can overcome the disadvantage of the existing zippers which can have foreign material easily caught between the teeth of the zipper and can lead to failure of the entire zipper due to damage of a few teeth of the zipper. In addition, the track zipper of the present disclosure has a much stronger bearing capacity, and therefore it cannot be easily damaged or pulled apart even by a strong force.

In general, the structure of the track zipper of the present disclosure is introduced, and the implementation of the track zipper of the present disclosure is illustrated in the following embodiments.

FIGS. 1*a* to 1*i* are schematic diagrams of an embodiment of the track zipper of the present disclosure. In this embodiment, the track zipper may include a first track 02 and a second track 03. The first track 02 may be connected to a first material 51, and the second track 03 may be connected to a second material 52. A zipper core 01 may be used to connect the first track 02 and the second track 03. A head portion of the zipper core 01 may be provided with a handle 81. The head portion of the zipper core 01 may also be provided with guiding portions 011 and 011', as well as guiding portions 012 and 012'. The guiding portions 011 and 011' can be two different designs of the guiding portion of the same zipper core. The guiding portions 012 and 012' are also the same. The only difference is that the guiding portions 011' and 012' do not have extra avoiding space while the guiding portions 011 and 012 are provided with extra avoiding space. Furthermore, their cylindrical portions, including 013 to 016, can be replaced with wheels or bearings. When the zipper core 01 is pulled downwards, the top ends, the cylindrical portions, or the bearings of the guiding portions 011 or 011' and 012 or 012' can be used to push the first track 02 and the second track 03 open. When the zipper core 01 is pulled upwards, the cylindrical portions or the bearings of the guiding portions 013 to 016 can be used to squeeze the first track 02 and the second track 03 towards the zipper core 01. As with the traditional zipper, when the zipper core 01 is pulled up and down, zipper teeth 021 and 031 are also closed or opened. As can be seen from the cross-sectional view, the zipper teeth 021 and 031 are not engaged with each other. They are located between the zipper core 01 and the first/second tracks 02, 03. To separate the first track 02 and the second track 03, they must be expanded in order to separate from the zipper core 01. The first track 02 can prevent the zipper tooth 031 from moving outwards, thus limiting the expansion of the second track 03. Similarly, the second track 03 can prevent the zipper teeth 021 from moving outwards, thus limiting the expansion of the first track 02. It is understood that even without the zipper teeth 021 and 031, the first track 02 and the second track 03 are difficult to be separated. Hence, the zipper teeth 021 and 031 may not be required. It is based on the need in order to determine whether it is required to include the zipper teeth 021 and 031.

Figure 1I:
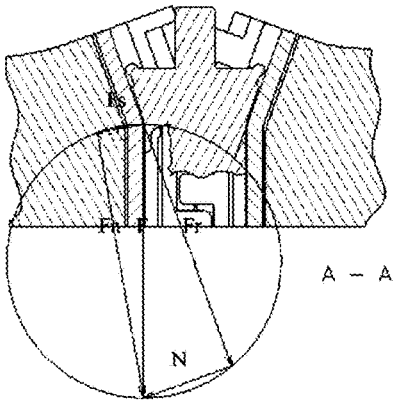
FIG. 1*i* is a cross-sectional view of the A-A plane in FIG. 1*h;*

FIG. 1*i* is a force analysis diagram of the head portion of the zipper core 01 of the track zipper, wherein F is the diameter of the circle. Since Fn and N are perpendicular to Fs and Fr respectively, the figure is completed by using only a few lines. F is the force that is applied to pull the handle. Fs is the force that is applied to push the first and second tracks open. It is most directly related to the mechanical property of the material of the first and second tracks. Fr is the frictional force of the zipper core when it moves between the first and second tracks. Its inclined angle is the same as the inclined angle of the zipper core. That is, changing the inclined angle of the zipper core can change the frictional force. Of course, it can greatly improve by the addition of bearings. Stress analysis will not be discussed here in detail. One can pay attention to F, Fs and Fr only. The zipper core slides in the first and second tracks simultaneously. Thus, although only the left side is shown in the figure, the right side is a mirror image of the left side. Thus, the total force to push the first and second tracks open=2Fs. The frictional force generated between the zipper core and the first and second tracks=2Fr.

Figure 1J:
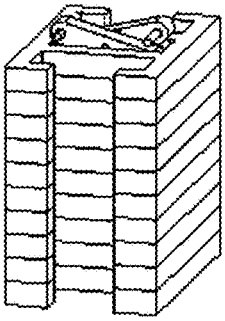
FIG. 1*j* is a schematic diagram of a collapsible zipper core of the track zipper of the present disclosure in a collapsed position.
Figure 1K:
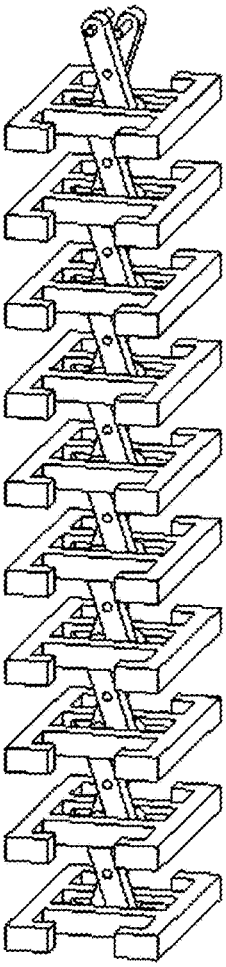
FIG. 1*k* is a schematic diagram of the collapsible zipper core of the track zipper of the present disclosure in an expanded position.

FIGS. 1*j* and 1*k* are schematic diagrams of a collapsible zipper core, wherein FIG. 1*j* is a schematic diagram of the zipper core in a collapsed position, and FIG. 1*k* is a schematic diagram of the zipper core in an expanded position.

FIGS. 2*a* to 2*j* are schematic diagrams of another embodiment of the track zipper of the present disclosure. In this embodiment, the track zipper may include a first track 12, a second track 13, and a zipper core 11 connecting the first track 12 and the second track 13. The first track 12 and a first side of the zipper core 11 may be provided with a first slidably connecting structure. The first slidably connecting structure can allow the zipper core to slide relative to the first track along a lengthwise direction of the first track, and thus making the zipper core inseparable from the first track in a direction perpendicular to the first track. The second track 13 and a second side of the zipper core 11 may be provided with a second slidably connecting structure, The second slidably connecting structure can allow the zipper core to slide relative to the second track along a lengthwise direction of the second track, and thus making the zipper core inseparable from the second track in a direction perpendicular to the second track. Specifically, in this embodiment, the first sliding connecting structure may include a first track portion 111 formed on the first side of the zipper core 11 and a first track groove 121 formed on the first track 12. The first track portion 111 can slide in the first track groove 121, but cannot be separated from the first track groove 121 in the direction perpendicular to the first track 12. The second slidably connecting structure may include a second track portion 112 formed on the second side of the zipper core 11, and a second track groove 131 formed on the second track 13. The second track portion 112 can slide in the second track groove 131, but cannot be separated from the second track groove 131 in the direction perpendicular to the second track 13. The first track 12 and first material 51 may be permanently connected by mechanical means and/or chemical substance and/or piercing (e.g., piercing using its own material, or using external materials such as sewing, rivets, etc). The second track 13 and second material 52 may also be permanently connected by mechanical means and/or chemical substance and/or piercing (e.g., piercing using its own material, or using external materials such as sewing, rivets, etc). A handle 81 may be provided on a head portion of the zipper core 11. The handle 81 can be flipped up and down. The first and second tracks may be made of metal or thermoplastic materials, such as acrylonitrile-butadiene-styrene copolymer, polycarbonate, polyoxymethylene resin, polyamide resin, etc.

Figure 2A:
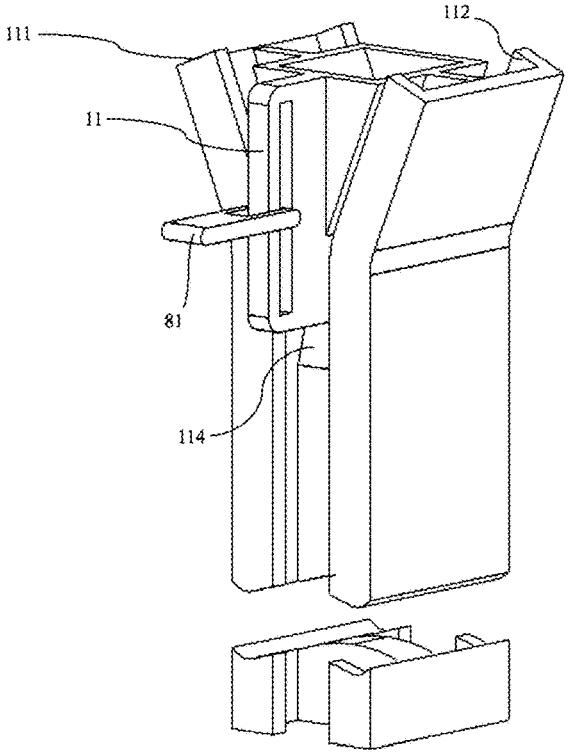
FIG. 2*a* is a schematic diagram of the zipper core according to another embodiment of the track zipper of the present disclosure.
Figure 2B:
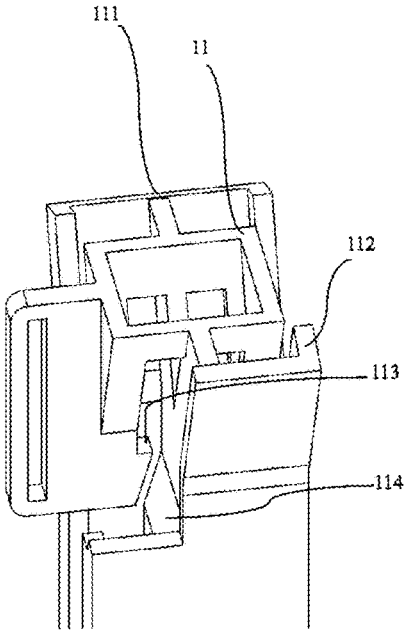
FIG. 2*b* is a schematic cutaway diagram of the zipper core as shown in FIG. 2*a;*
Figure 2C:
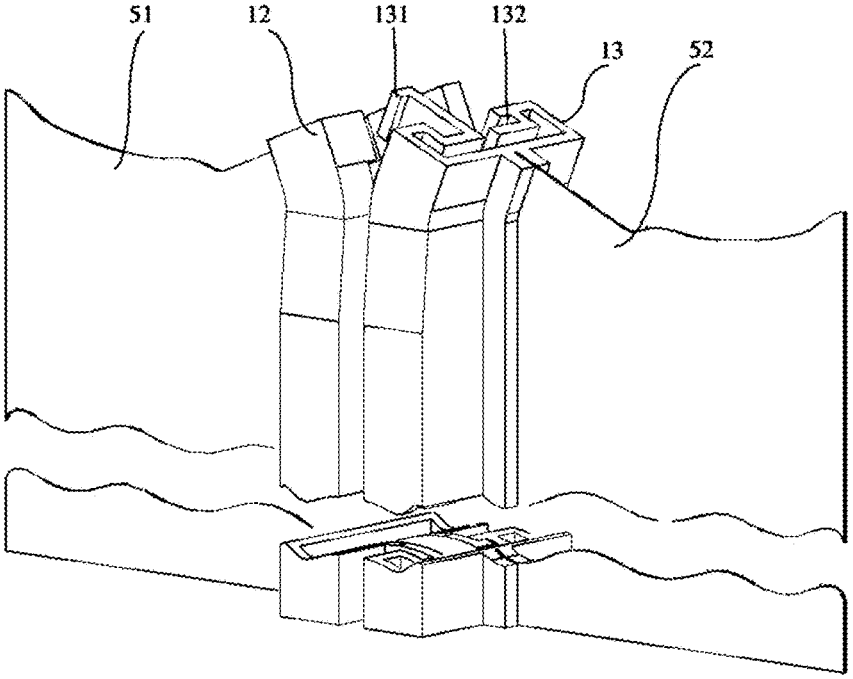
FIG. 2*c* is a schematic diagram of the first and second tracks according to another embodiment of the track zipper of the present disclosure.
Figure 2D:
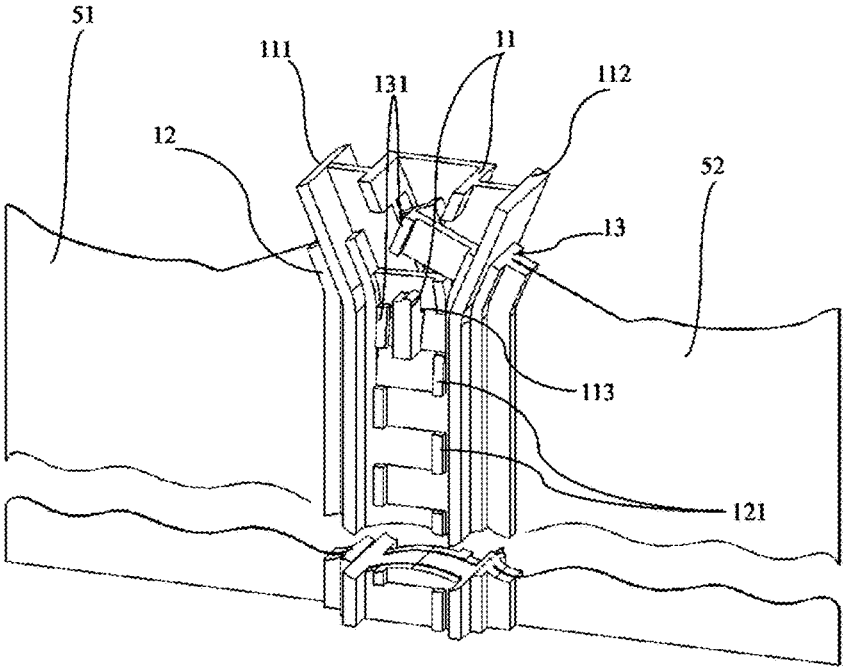
FIG. 2*d* is a schematic diagram in which the zipper core is coupled with the first track and the second track according to another embodiment of the track zipper of the present disclosure.
Figure 2E:
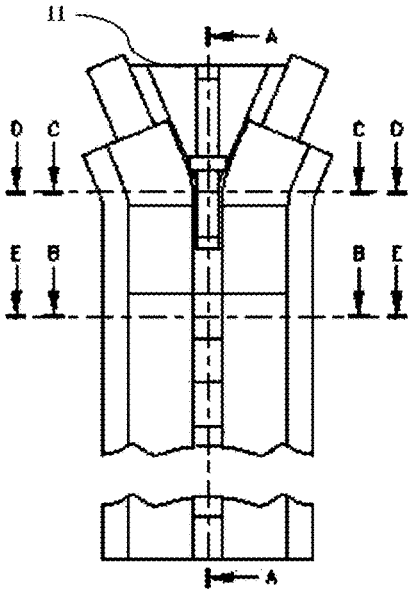
FIG. 2*e* is a front schematic diagram of another embodiment of the track zipper of the present disclosure.
Figure 2F:
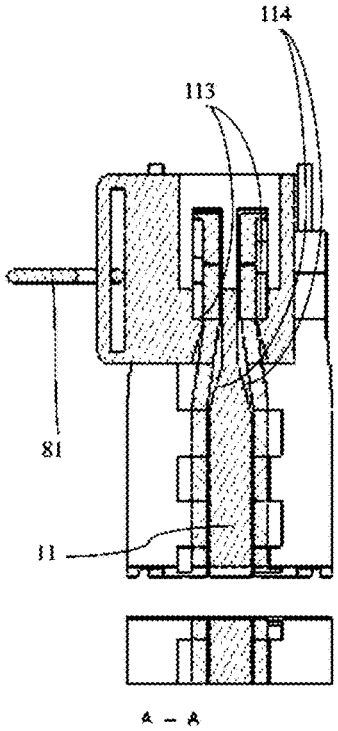
FIG. 2*f* is a cross-sectional view at the A-A plane in FIG. 2*e;*
Figure 2G:
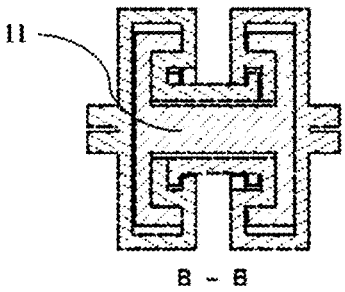
FIG. 2*g* is a cross-sectional view at the B-B plane in FIG. 2*e;*
Figure 2H:
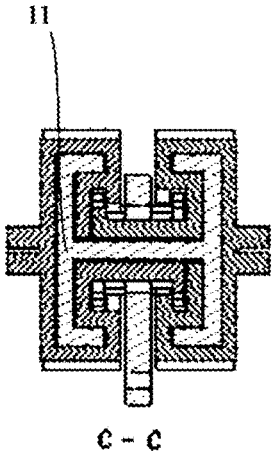
FIG. 2*h* is a cross-sectional view at the C-C plane in FIG. 2*e;*
Figure 2I:
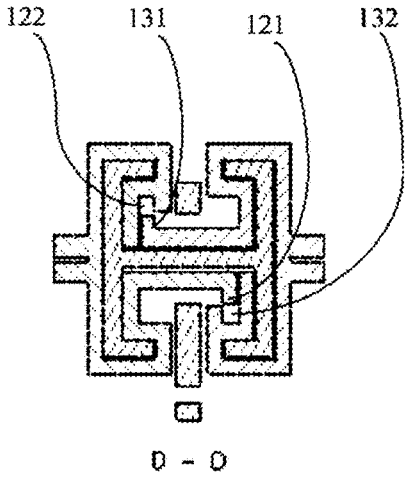
FIG. 2*i* is a cross-sectional view at the D-D plane in FIG. 2*e;*
Figure 2J:
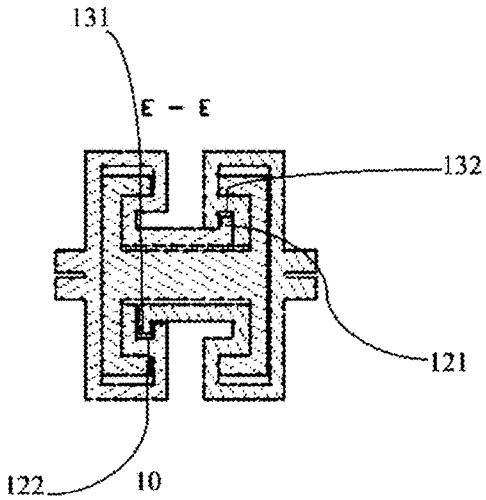
FIG. 2*j* is a cross-sectional view at the E-E plane in FIG. 2*e;*

Referring to FIG. 2*a*, the function of the Y-shaped guiding portion of the zipper core 11 with its head portion diverging outwards is similar to a traditional zipper, i.e. to open and close the track zipper. FIG. 2*b* is a cutaway view of the zipper core 11 which shows a guiding portion 113 for pressing zipper teeth inwards, and a guiding portion 114 for pressing zipper teeth outwards. In FIG. 2*d*, portions of the zipper core 11, the first track 12 and the second track 13 are cut away to reveal alternating zipper teeth 121 and 131. FIGS. 2*e* to 2*j* show some cross sectional views of the track zipper. It can be seen that the zipper core 11 forces the zipper teeth 121 and 131 into respective recesses 132 and 122 between the zipper teeth. In a narrow, upper portion of the guiding portion 114 of the zipper core 11, the zipper teeth 121 and 131 are pressed by the guiding portion 114, and are not able to enter the respective recesses 132 and 122 between the zipper teeth.

Figure 3A:
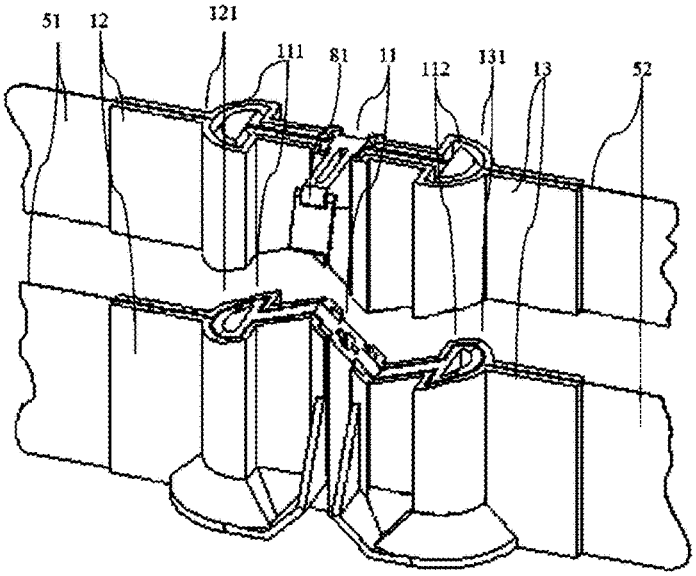
FIG. 3*a* is a schematic diagram of another embodiment of the track zipper of the present disclosure.
Figure 3B:
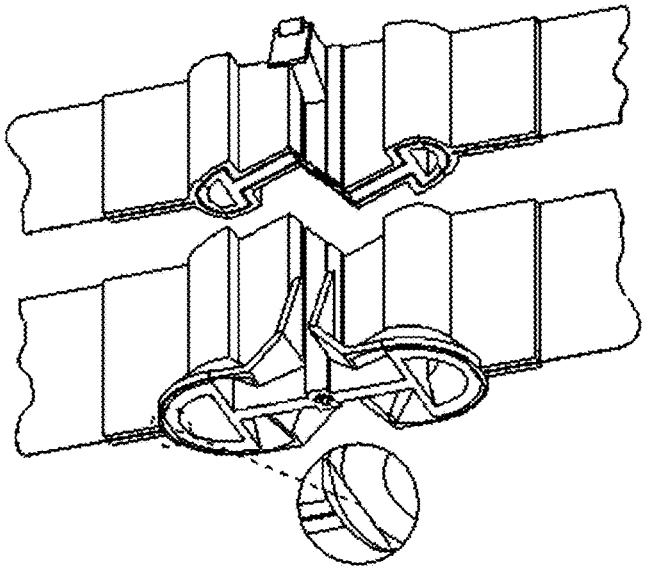
FIG. 3*b* is a schematic diagram of another view of the track zipper as shown in FIG. 3*a;*
Figure 3C:
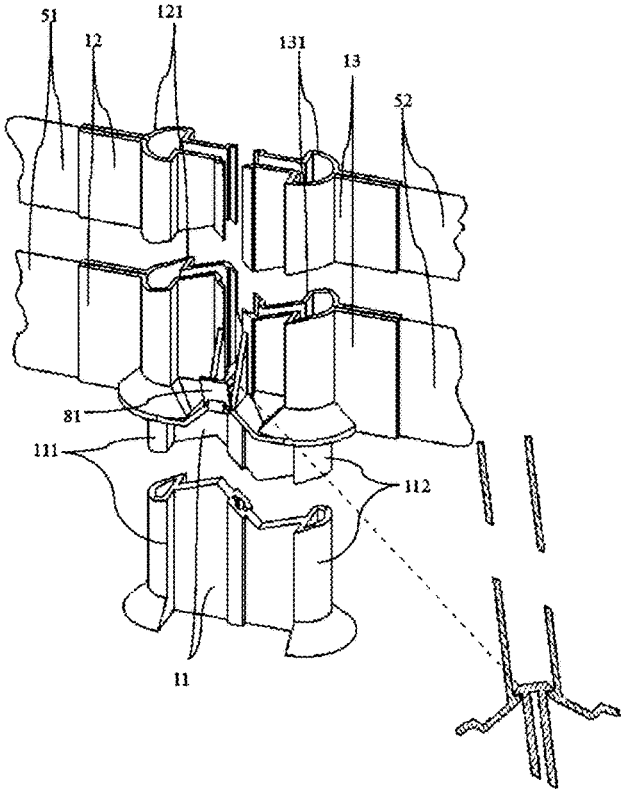
FIG. 3*c* is a schematic diagram of the track zipper shown in FIG. 3*a;*
Figure 3D:
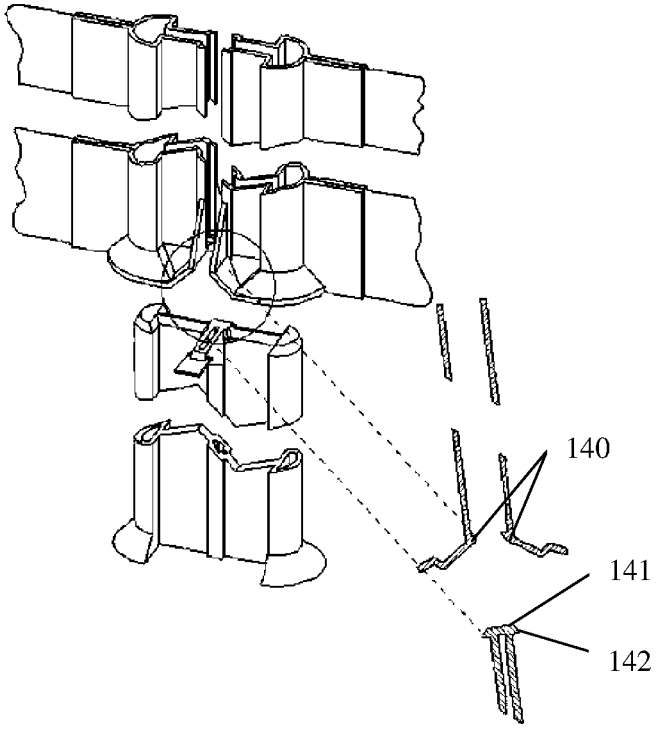
FIG. 3*d* is another schematic diagram of the track zipper shown in FIG. 3*a;*
Figure 3E:
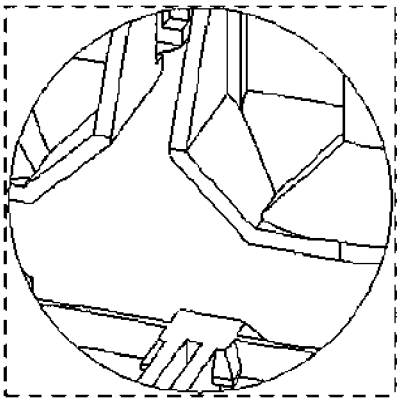
FIG. 3*e* is a partial enlarged diagram of FIG. 3*d;*
Figure 3F:
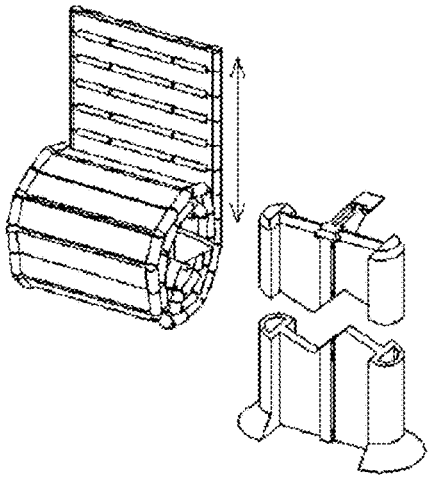
FIG. 3*f* is a schematic diagram of the rolling up mode of the zipper core in the track zipper of the present disclosure.
Figure 3G:
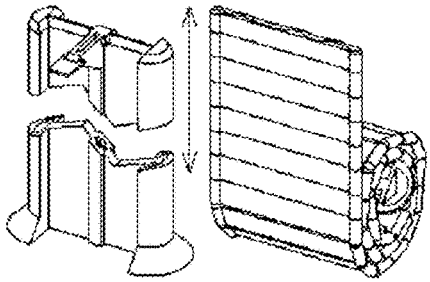
FIG. 3*g* is a schematic diagram of another rolling up mode of the zipper core in the track zipper of the present disclosure.
Figure 3H:
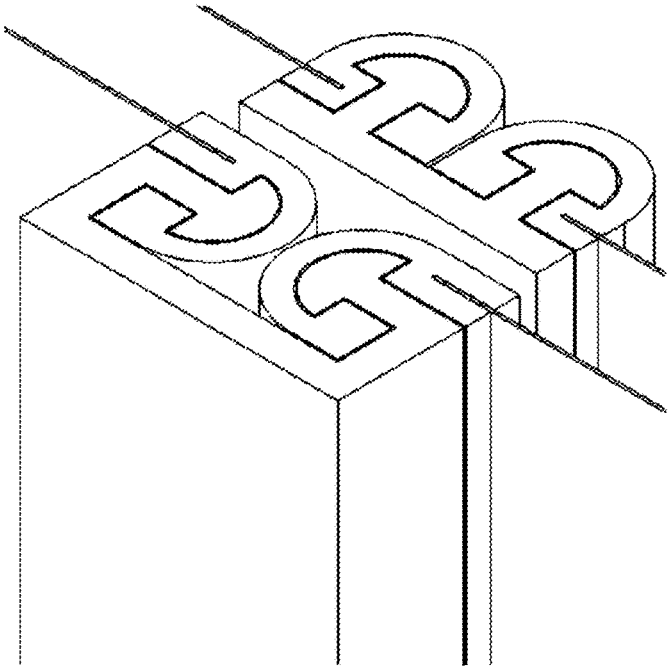
FIG. 3*h* is a schematic diagram of another structure of the track zipper of the present disclosure.

FIGS. 3*a* to 3*h* are schematic diagrams of another embodiment of the track zipper of the present disclosure. In this embodiment, the track zipper may include a first track 12, a second track 13, and a zipper core 11 for connecting the first track 12 and the second track 13. As shown in FIGS. 3*c* and 3*d*, the first track 12 and the second track 13 may be formed with some hooks 140 that can engage with an enlarged upper end 141 of the zipper core 11 so that the zipper core 11 can be stopped at a specified position. The operation of the track zipper of the present embodiment will be described with reference to the drawings. As shown in FIG. 3*c*, at this time the zipper core 11 is not connected to the first track 12 and the second track 13. The handle 81 is then pulled up. Since the upper end of the zipper core 11 has slanted surfaces 142, and the lower end of the first track 12 and the second track 13 is enlarged, this configuration can facilitate the insertion of the zipper core 11 into the first track 12 and the second track 13. FIG. 3*b* shows that the zipper core 11 has entered the first track 12 and the second track 13. When the handle 81 is pulled further upwards, the material 51 and the material 52 are connected together through the first track 12 and the second track 13, as shown in FIG. 3*a*. To open the track zipper, the zipper core 11 is pulled downwards. The first track 12 and the second track 13 are partially separated, as shown in FIG. 3*b*. If this is a zipper of a pair of trousers, then the pair of trousers can be taken off. When the handle 81 is pulled further downwards, the first track 12 and the second track 13 will be completely separated. In general, the zipper core 11 will be attached or hidden in one of the first and second tracks 12, 13. FIGS. 3*f* and 3*g* show that the portion of the zipper core 11 that is not inserted into the first track 12 and the second track 13 can be rolled up. FIG. 3*h* shows the structure of another track zipper. It can be seen that the openings of the track grooves on the first and second tracks can be facing any directions.

Figure 4A:
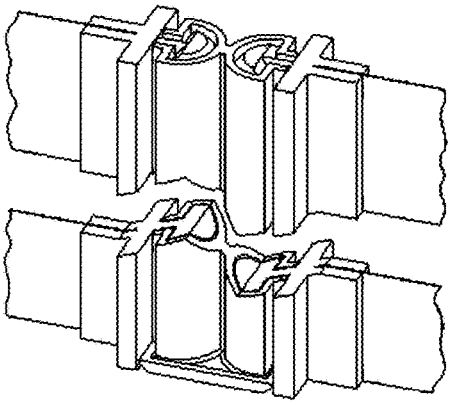
FIG. 4*a* is a schematic diagram of another embodiment of the track zipper of the present disclosure.
Figure 4B:
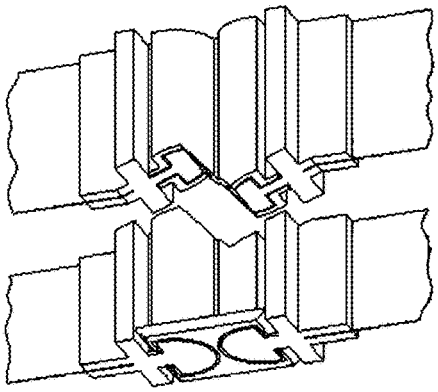
FIG. 4*b* is a schematic diagram of another view of the track zipper as shown in FIG. 4*a;*
Figure 4C:
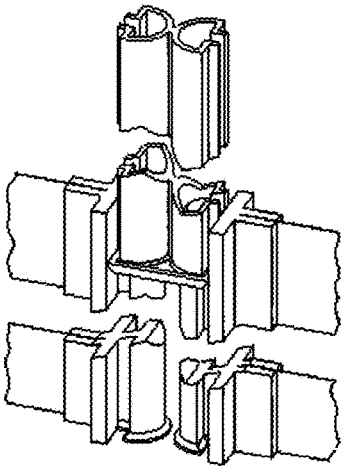
FIG. 4*c* is a schematic diagram of the track zipper shown in FIG. 4*a;*
Figure 4D:
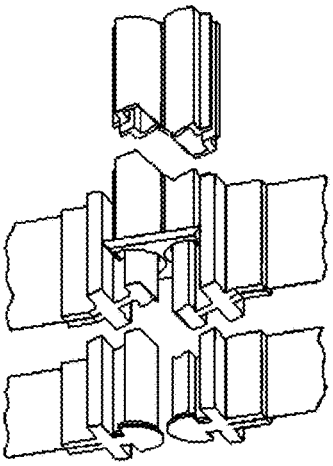
FIG. 4*d* is a schematic diagram of another view of the track zipper as shown in FIG. 4*a;*
Figure 4E:
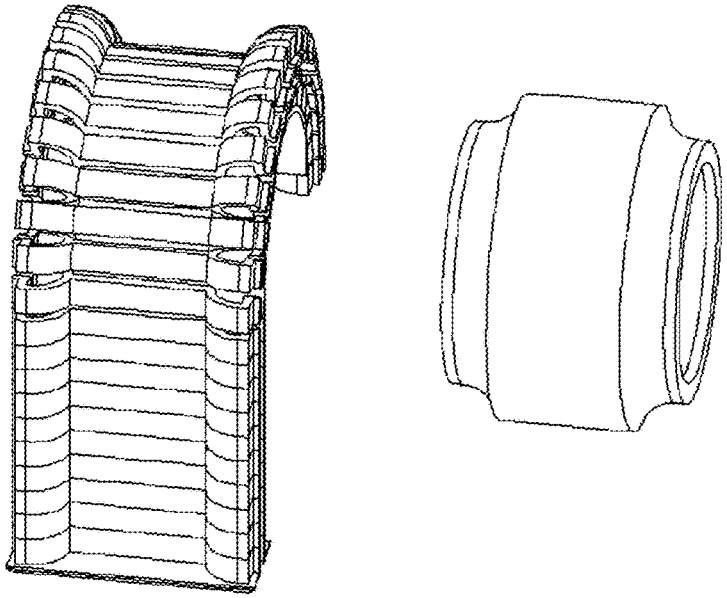
FIG. 4*e* is a schematic diagram of the rolling up mode of the zipper core in the track zipper of the present disclosure.
Figure 4F:
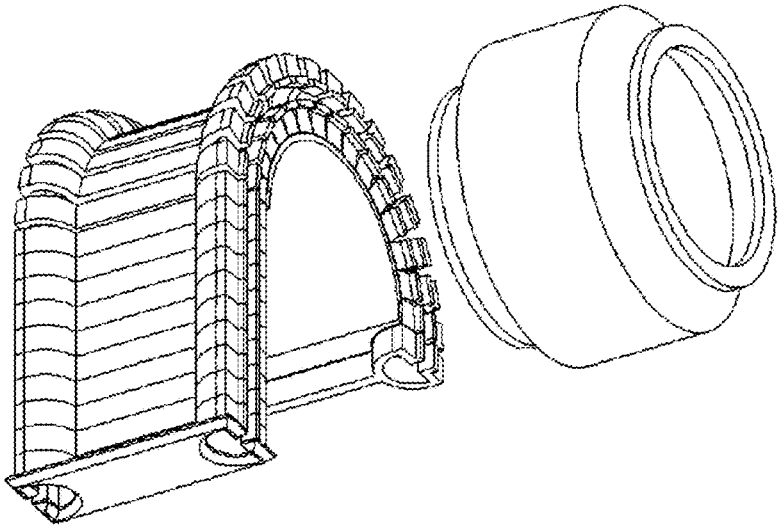
FIG. 4*f* is a schematic diagram of another rolling up mode of the zipper core in the track zipper of the present disclosure.
Figure 4G:
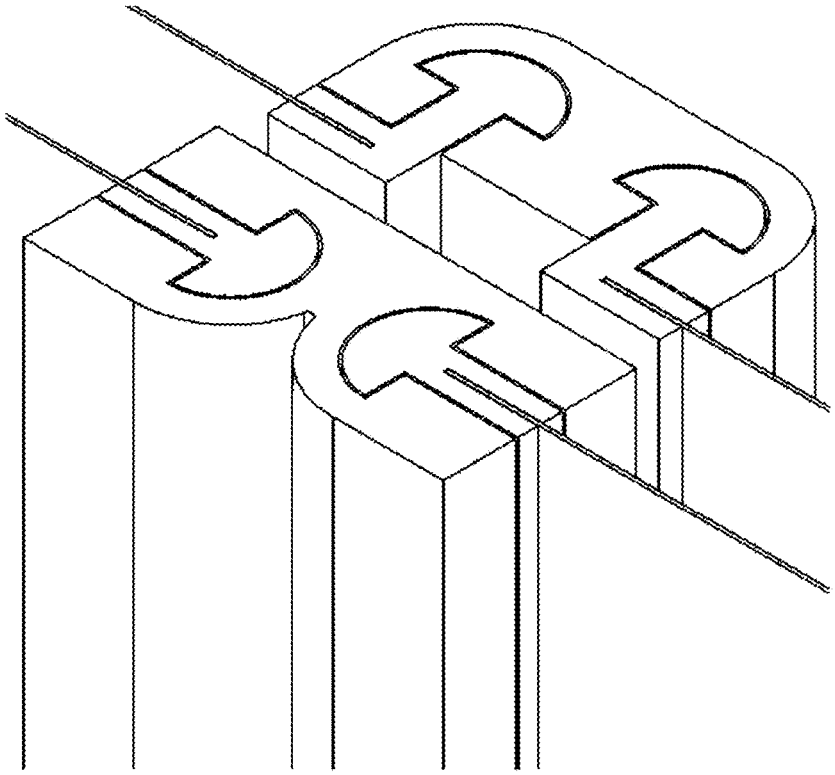
FIG. 4*g* is a schematic diagram of another structure of the track zipper of the present disclosure.

FIGS. 4*a* to 4*g* are schematic diagrams of another embodiment of the track zipper of the present disclosure. In this embodiment, the track zipper may include a first track 12, a second track 13, and a zipper core 11 connecting the first track 12 and the second track 13. The structure of the track zipper in FIGS. 4*a* to 4*d* is similar to the structure of the track zipper in FIGS. 3*a* to 3*d*. The difference is that in the track zipper shown in FIGS. 3*a* to 3*d*, the first and second track grooves are formed on the first and second tracks, and the first and second track portions are respectively formed on two sides of the zipper core; whereas in the track zipper shown in FIGS. 4*a* to 4*d*, the first and second track portions are formed on the first and second tracks, and the first and second track grooves are respectively formed on two sides of the zipper core. The portion of the zipper core that has not been inserted into the first and second tracks can be rolled up on a circular or partially circular reel or channel, as shown in FIGS. 4*e* and 4*f*. FIG. 4*g* shows the structure of another track zipper. It can be seen that the openings of the first and second track grooves on the zipper core can be facing any directions.

Figure 5A:
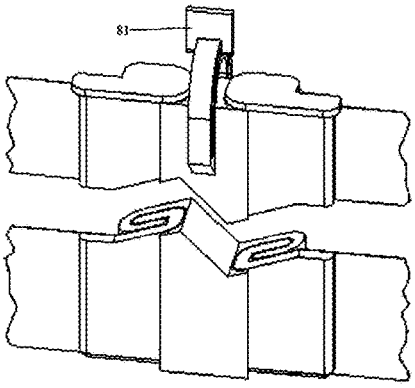
FIG. 5*a* is a schematic diagram of another embodiment of the track zipper of the present disclosure.
Figure 5B:
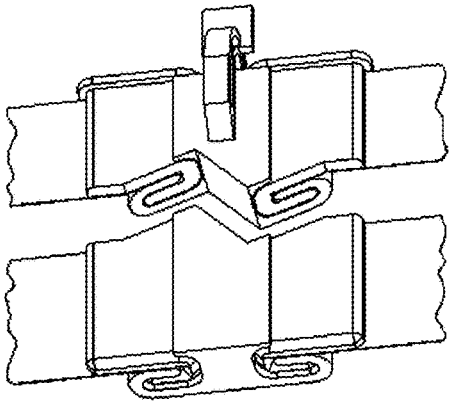
FIG. 5*b* is a schematic diagram of another view of the track zipper as shown in FIG. 5*a;*
Figure 5C:
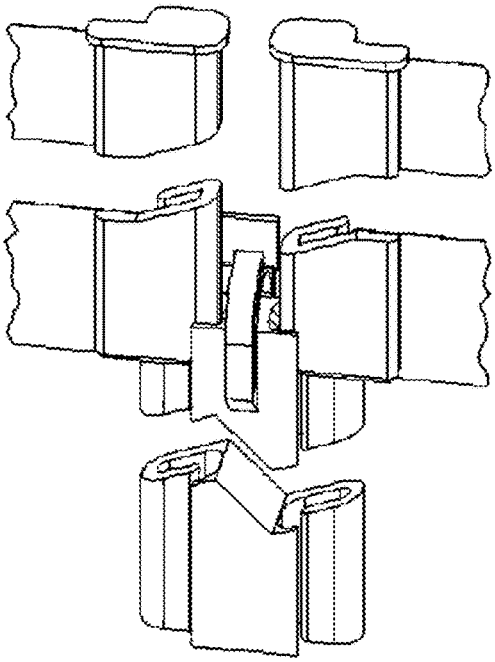
FIG. 5*c* is a schematic diagram of a partially opened track zipper of FIG. 5*a;*
Figure 5D:
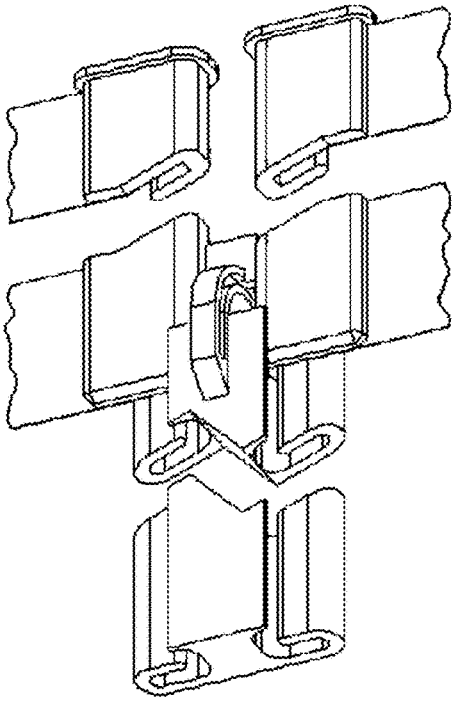
FIG. 5*d* is a schematic diagram of another view of the partially opened track zipper of FIG. 5*a;*
Figure 5E:
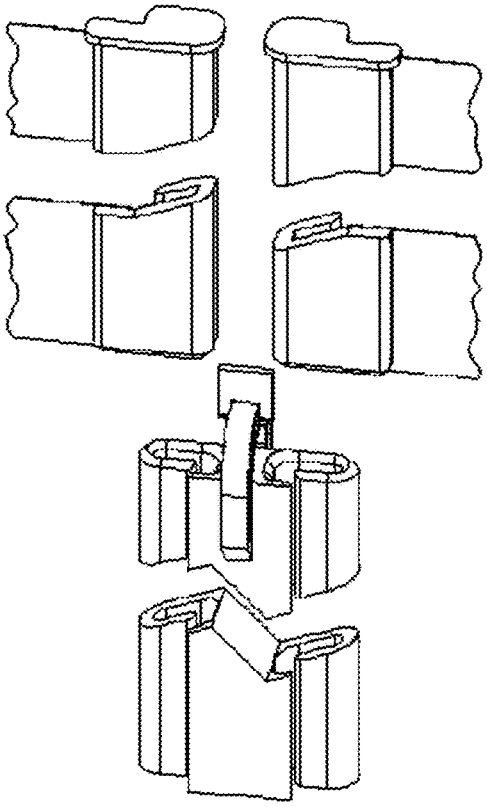
FIG. 5*e* is a schematic diagram of a fully opened position of the track zipper of FIG. 5*a;*
Figure 5F:
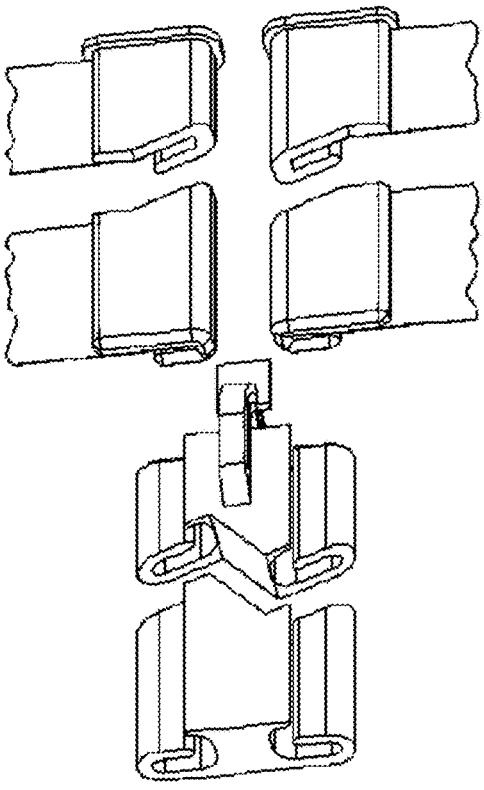
FIG. 5*f* is a schematic diagram of another view of the fully opened track zipper of FIG. 5*a;*

In the embodiments of several track zippers shown above, the parts of the track zipper are basically symmetric. It should be noted that this symmetrical structure is not necessary. FIGS. 5*a* to 5*f* are schematic diagrams of another embodiment of the track zipper of the present disclosure. In this embodiment, the structure of the parts of the track zipper is asymmetric. The handle on the zipper core is able to be moved to the front or rear of the zipper core, i.e. the handle can be positioned at the front or the rear of the zipper core. In FIGS. 5*a* and 5*b*, the track zipper is in a closed position, and the track portions of the zipper core are completely inserted into the corresponding track grooves of the first track and the second track. In FIGS. 5*c* and 5*d*, the track zipper is partially opened, and a portion of the track portions of the zipper core is inserted into the corresponding track grooves of the first and second tracks. In FIGS. 5*e* and 5*f*, the track zipper is in an open position, and the zipper core is detached from the first and second tracks.

Figure 6A:
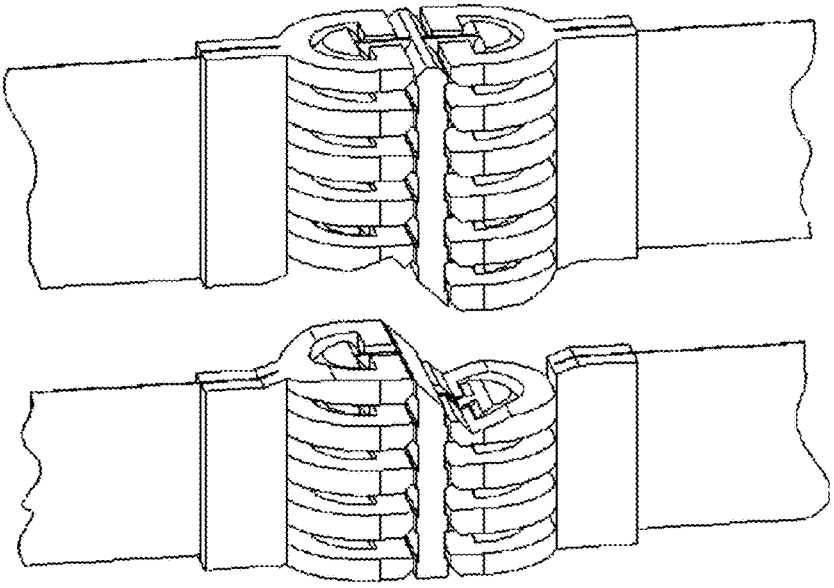
FIG. 6*a* is a schematic diagram of another embodiment of the track zipper of the present disclosure.
Figure 6B:
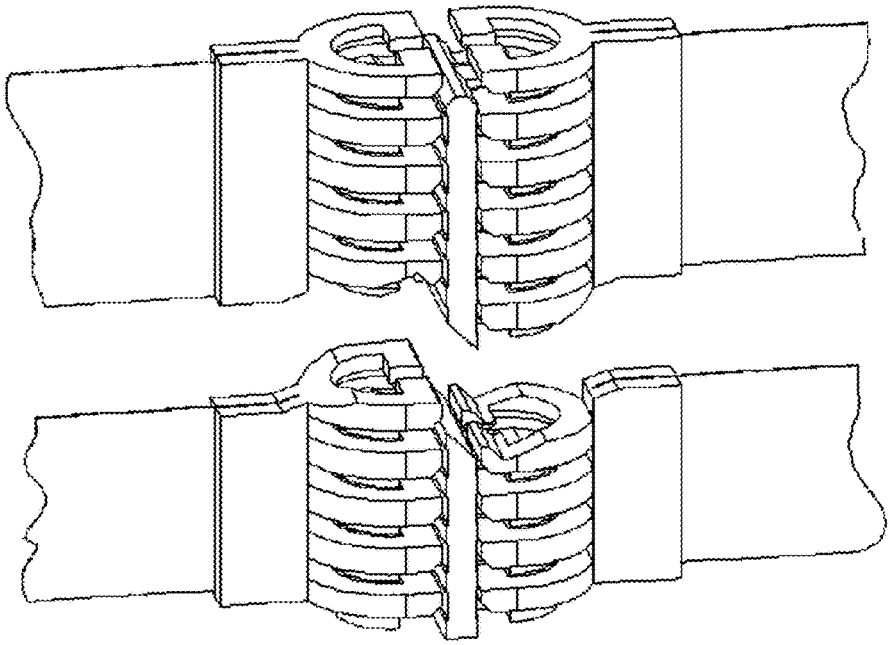
FIG. 6*b* is a schematic diagram of a partially opened track zipper of FIG. 6*a;*
Figure 6C:
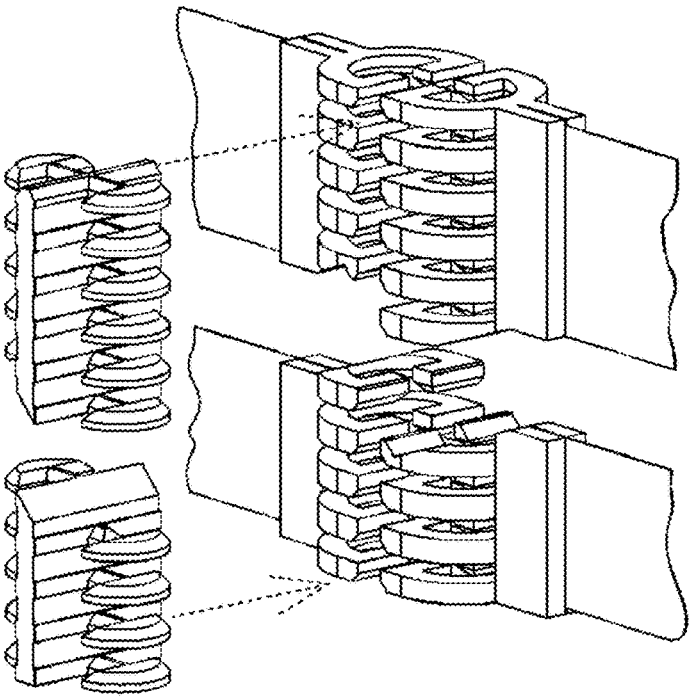
FIG. 6*c* is a schematic diagram of a fully opened track zipper of FIG. 6*a;*

FIGS. 6*a* to 6*c* are schematic diagrams of another embodiment of the track zipper of the present disclosure. In this embodiment, in order to reduce the travel distance of the zipper core, the zipper core is configured as a segmental structure. In FIG. 6*a*, the track zipper is in a closed position, and the track portions of the zipper core are completely inserted into the corresponding track grooves of the first and second tracks. In FIG. 6*b*, the track zipper is partially opened, and the track portions of a segment of the zipper core are inserted into the corresponding track grooves of the first and second tracks. In FIG. 6*c*, the track zipper is in an open position, and the zipper core is detached from the first and second tracks.

Figure 7A:
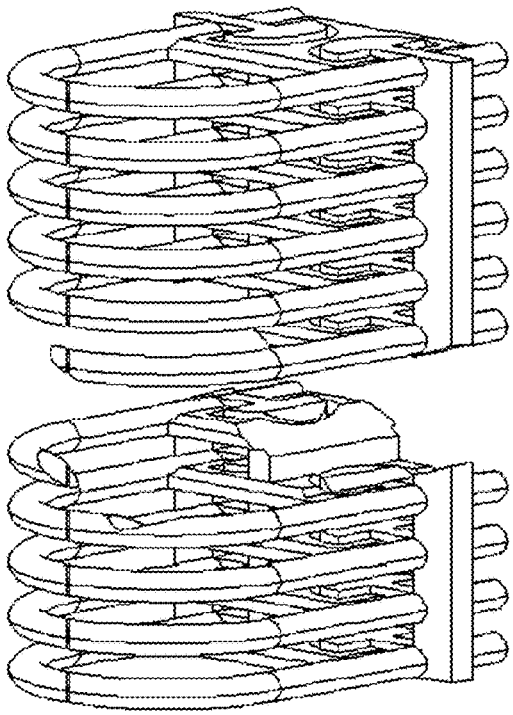
FIG. 7*a* is a schematic diagram of another embodiment of the track zipper of the present disclosure.
Figure 7B:
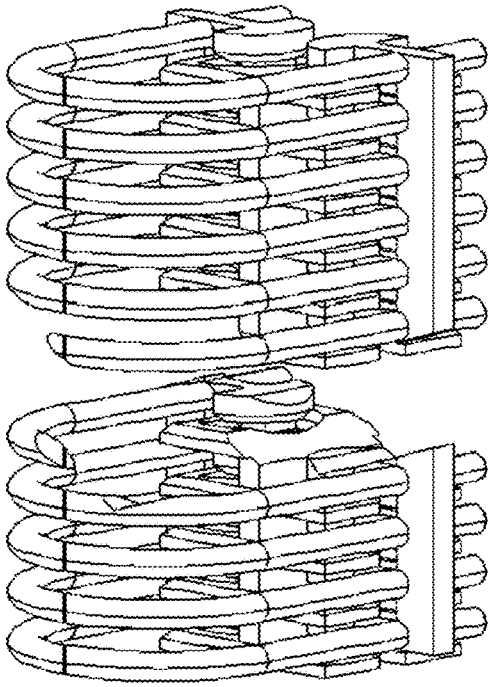
FIG. 7*b* is a schematic diagram of a partially opened track zipper of FIG. 7*a;*
Figure 7C:
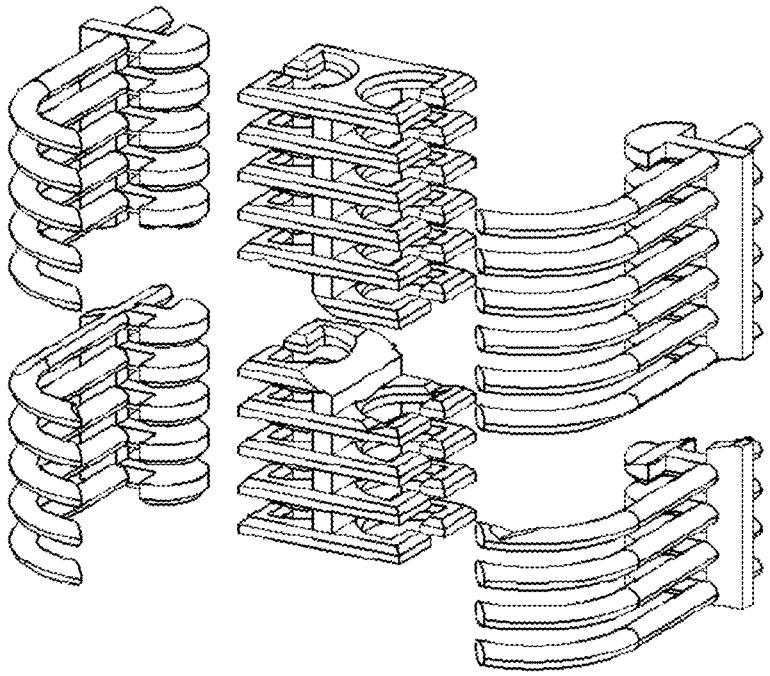
FIG. 7*c* is a schematic diagram of a fully opened track zipper of FIG. 7*a;*

FIGS. 7*a* to 7*c* are schematic diagrams of another embodiment of the track zipper of the present disclosure. In this embodiment, the same segmental structure of the zipper core is adopted to reduce the travel distance of zipper core. In addition, some loops similar to those loose-leaf rings are provided. In FIG. 7*a*, the zipper core fits perfectly in the first track and the second track. In FIG. 7*b*, the zipper core can be moved down by one segment, and the first and second tracks in that segment are not engaged. In FIG. 7*c*, the zipper core is removed from the first and second tracks, and the track zipper is in an open position.

Figure 8A:
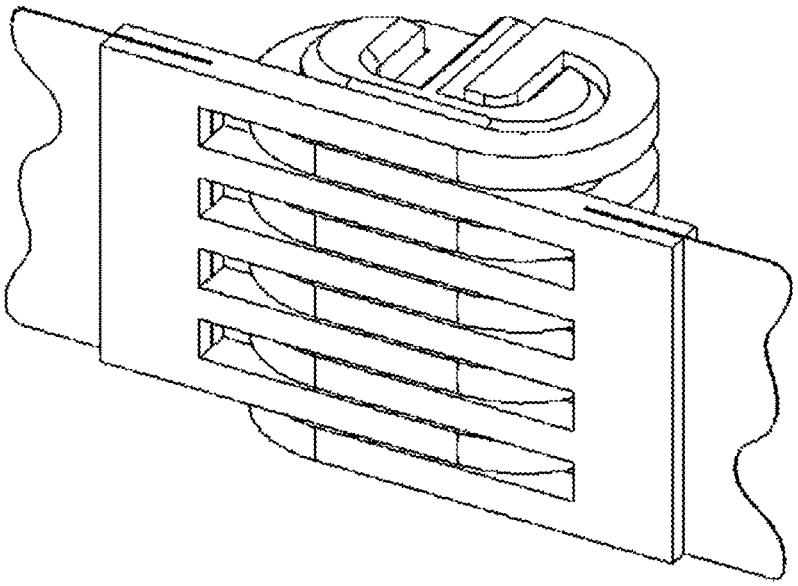
FIG. 8*a* is a schematic diagram of another embodiment of the track zipper of the present disclosure.
Figure 8B:
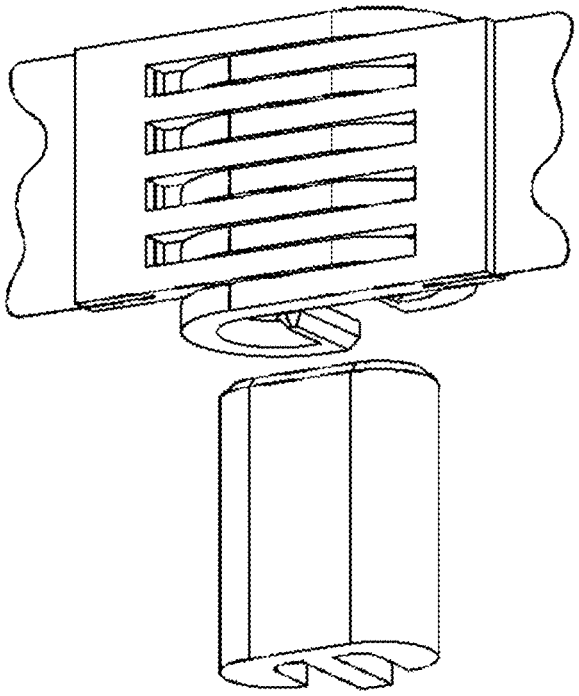
FIG. 8*b* is a schematic diagram of an opened track zipper of FIG. 8*a;*

FIGS. 8*a* and 8*b* are schematic diagrams of another embodiment of the track zipper of the present disclosure. In this embodiment, the first and second tracks of the track zipper can be staggered and overlapped, and then mated with the zipper core.

Figure 9A:
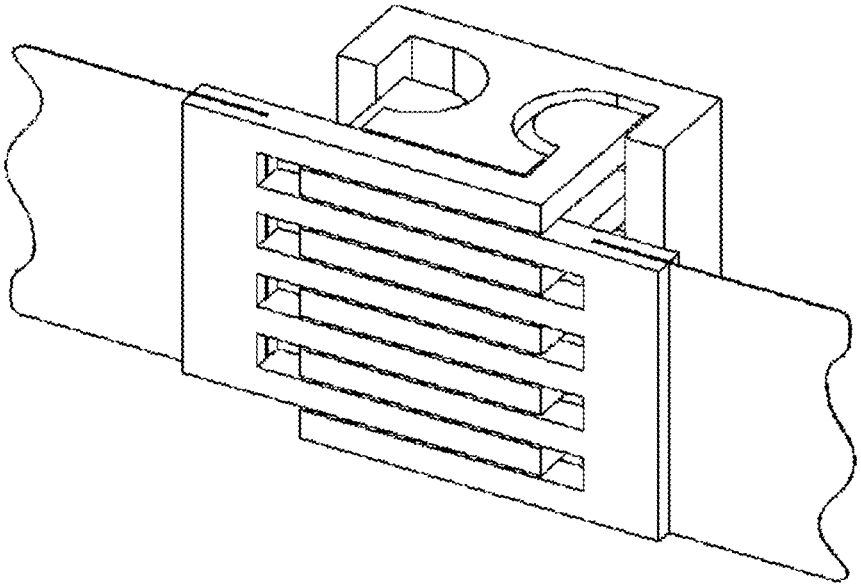
FIG. 9*a* is a schematic diagram of another embodiment of the track zipper of the present disclosure.
Figure 9B:
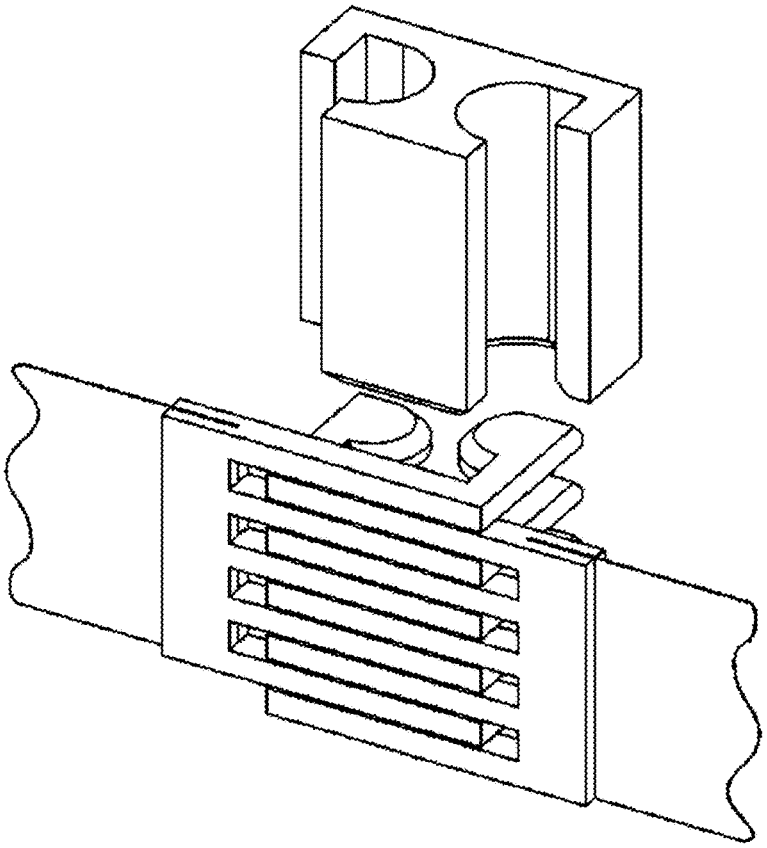
FIG. 9*b* is a schematic diagram of an opened track zipper of FIG. 9*a;*

FIGS. 9*a* and 9*b* are schematic diagrams of another embodiment of the track zipper of the present disclosure. The embodiment is a modified version of the track zipper shown in FIGS. 8*a* and 8*b*. That is, the positions of the track portions and the track grooves on the zipper core, and the first and second tracks are switched.

Figure 10A:
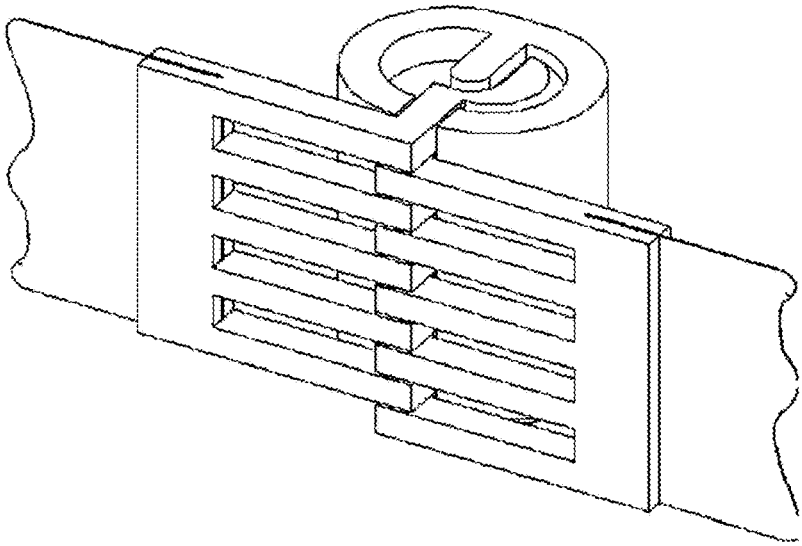
FIG. 10*a* is a schematic diagram of another embodiment of the track zipper of the present disclosure.
Figure 10B:
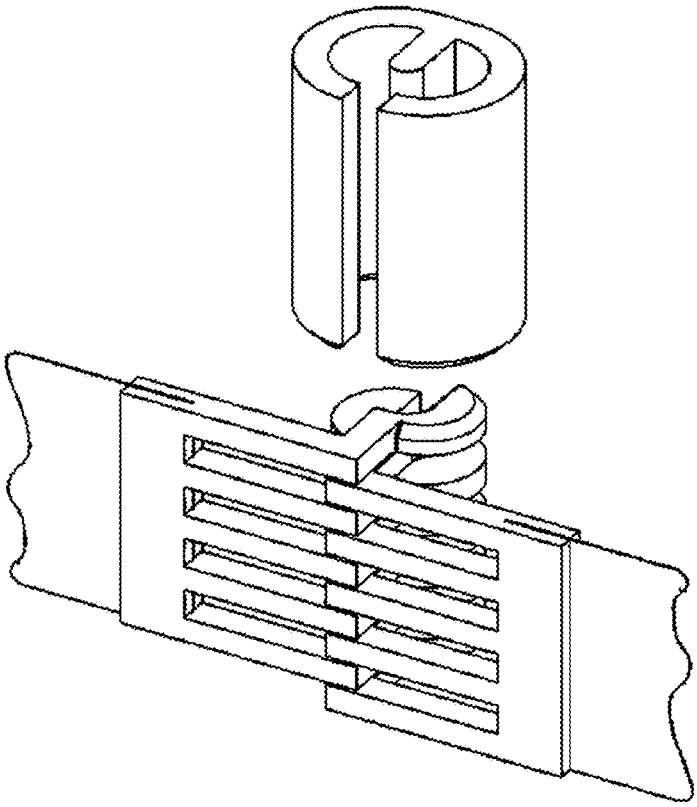
FIG. 10*b* is a schematic diagram of an opened track zipper of FIG. 10*a;*

FIGS. 10*a* and 10*b* are schematic diagrams of another embodiment of the track zipper of the present disclosure. This embodiment is a modified version of the track zipper shown in FIGS. 9*a* and 9*b*. In this embodiment, the directions of the track grooves and the track portions on the zipper core, and the first and second tracks are adjusted.

Figure 11A:
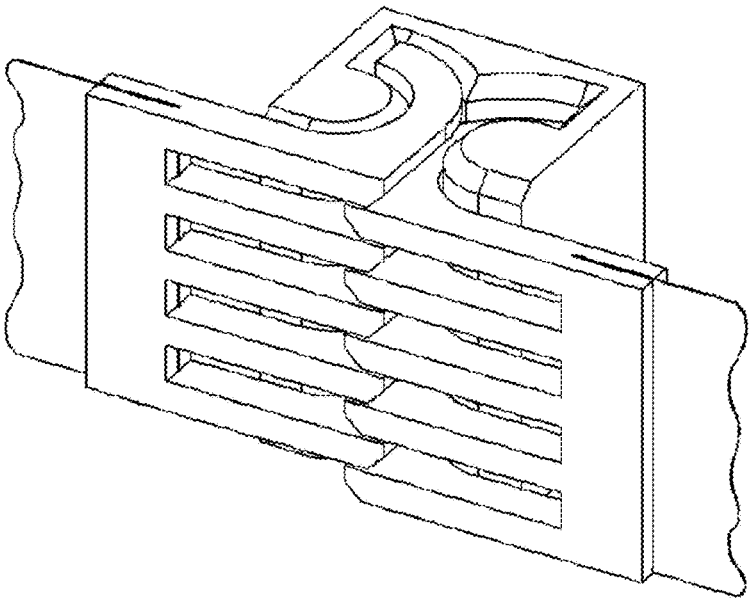
FIG. 11*a* is a schematic diagram of another embodiment of the track zipper of the present disclosure.
Figure 11B:
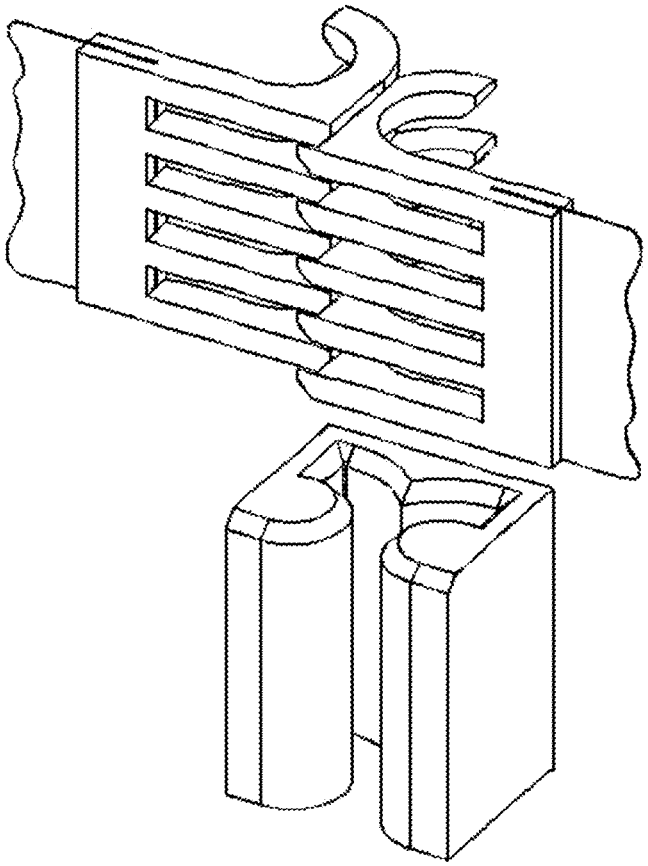
FIG. 11*b* is a schematic diagram of an opened track zipper of FIG. 11*a;*

FIGS. 11*a* and 11*b* are schematic diagrams of another embodiment of the track zipper of the present disclosure. This embodiment is a modified version of the track zipper shown in FIGS. 9*a* and 9*b*. In this embodiment, the shapes of the track grooves and the track portions on the zipper core, and the first and second tracks are changed.

Figure 12:
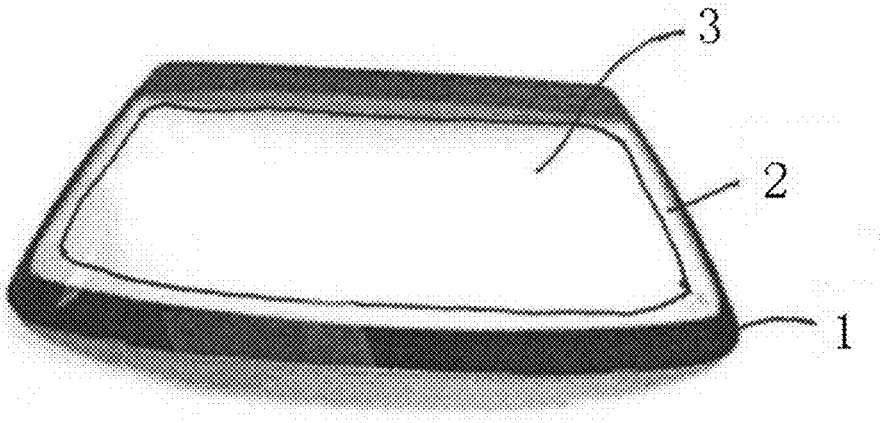
FIG. 12 is a schematic diagram of the car windshield with the track zipper of the present disclosure.

FIG. 12 shows an embodiment of the connecting structure with a track zipper of the present disclosure. This embodiment relates to windshield of a vehicle. It may include a windshield frame 1, a track zipper 2, and a windshield 3. The first track of the track zipper 2 may be connected with the windshield frame 1, and the second track of the track zipper 2 may be connected with the windshield 3, and the zipper core of the track zipper 2 connects the first and second tracks together. To install and change the windshield, one can simply pull the zipper core in or out of the first and second tracks. This greatly facilitates the installation and maintenance of windshields.

Figure 13:
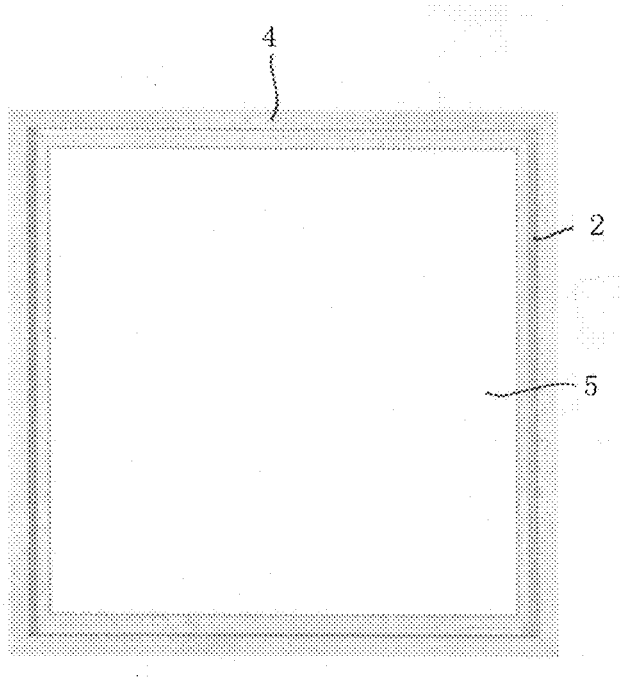
FIG. 13 is a schematic diagram of a window with the track zipper of the present disclosure.

FIG. 13 shows another embodiment of the connecting structure with a track zipper of the present disclosure. This embodiment relates to a window of a building. A window glass 5 can be secured in a window frame 4 of the building by using a track zipper 2 of the present disclosure. Same as the windshield, it can facilitate the installation and replacement of window glasses.

Figure 14:
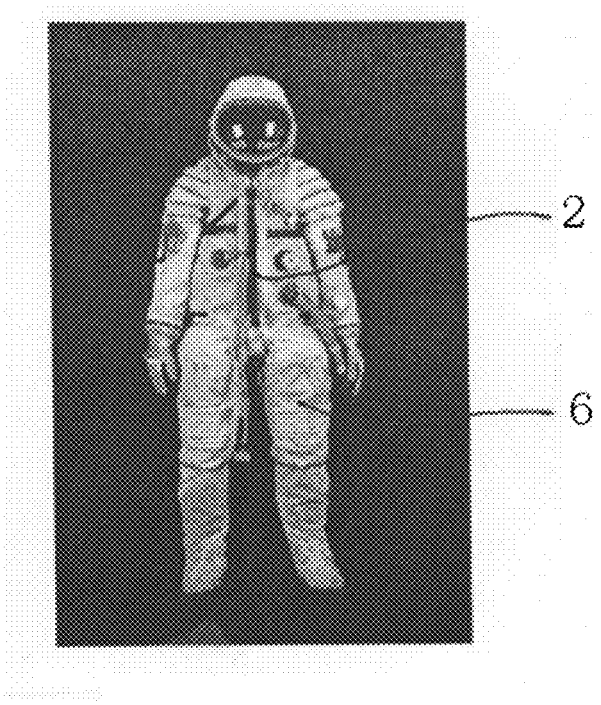
FIG. 14 is a schematic diagram of a space suit with the track zipper of the present disclosure.

FIG. 14 shows another embodiment of the connecting structure with a track zipper. This embodiment relates to a pressure space suit 6 capable of withstanding pressure. A track zipper 2 of the present disclosure can be installed on the pressure space suit 6.

Figure 15:
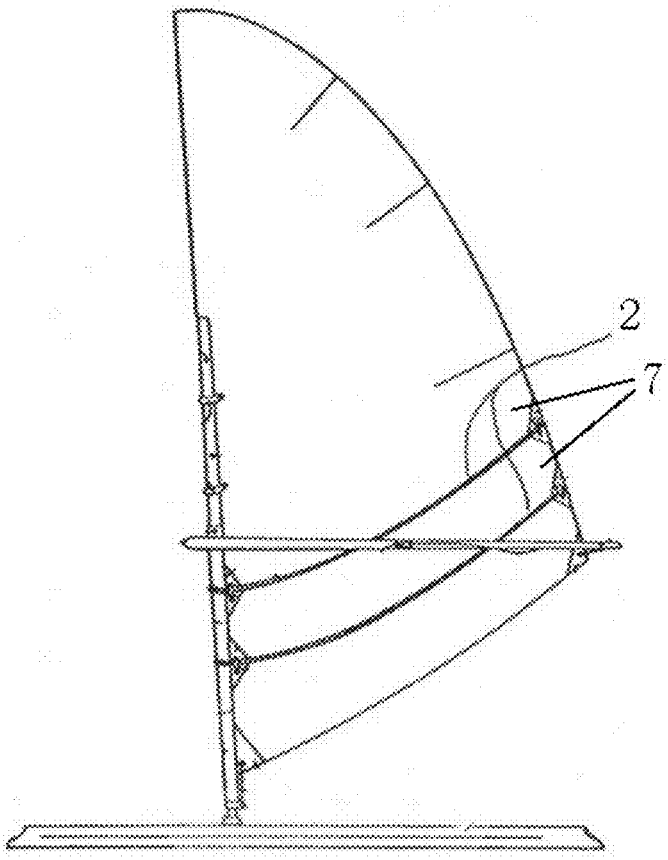
FIG. 15 is a schematic diagram of a sail with the track zipper of the present disclosure.
Figure 16A:
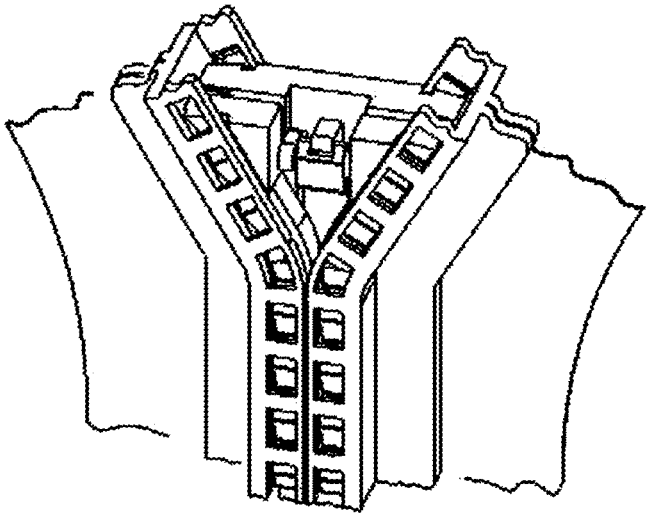
FIG. 16*a* is a schematic diagram of another embodiment of the track zipper of the present disclosure.
Figure 16B:
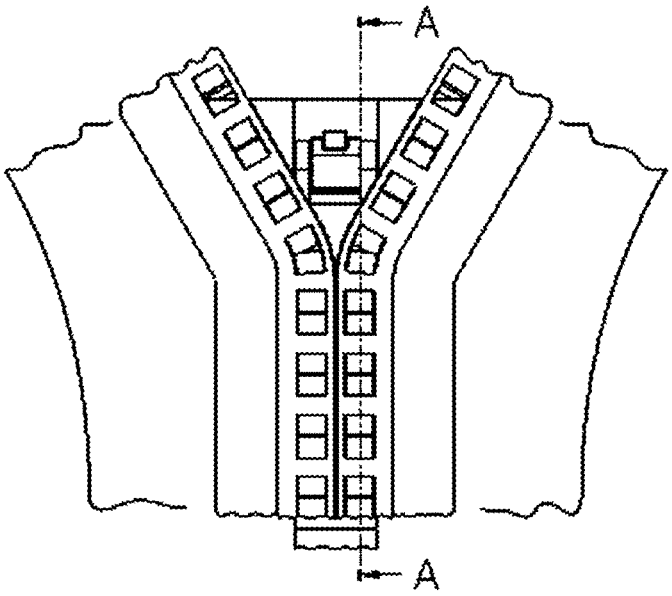
FIG. 16*b* is a front view of the track zipper shown in FIG. 16*a;*
Figure 16C:
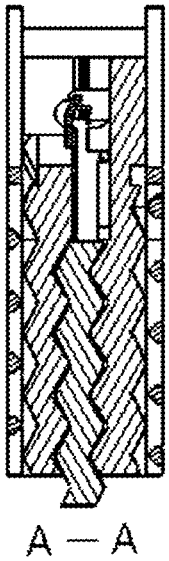
FIG. 16*c* is a cross-sectional view at the A-A plane in FIG. 16*b;*
Figure 16D:
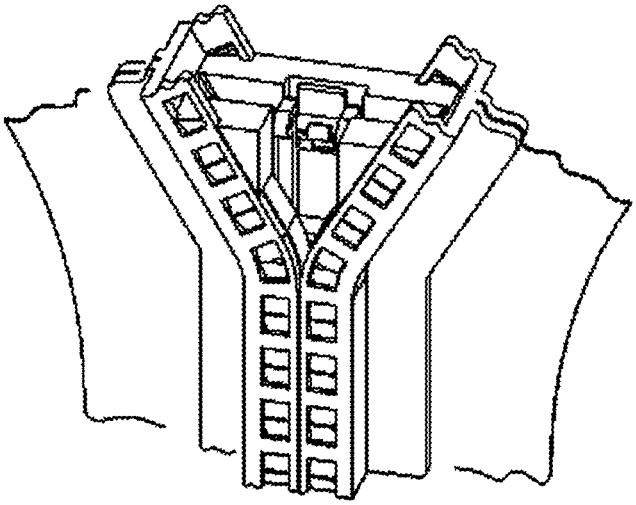
FIG. 16*d* is a schematic diagram of the track zipper shown in FIG. 16*a* in a closed position.
Figure 16E:
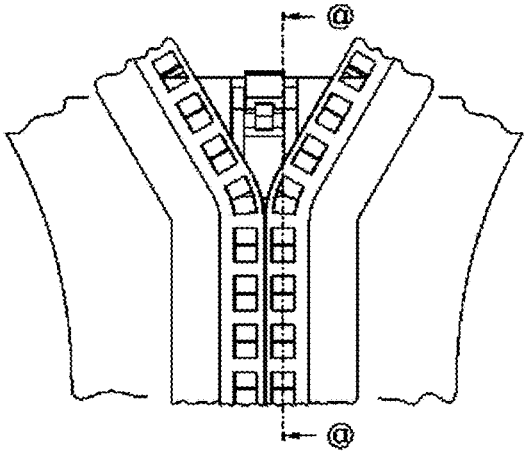
FIG. 16*e* is a front view of the track zipper shown in FIG. 16*d;*
Figure 16F:
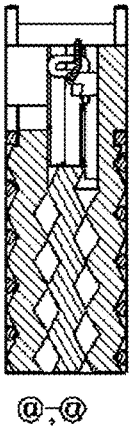
FIG. 16*f* is cross-sectional view at @-@ in FIG. 16*e;*
Figure 17A:
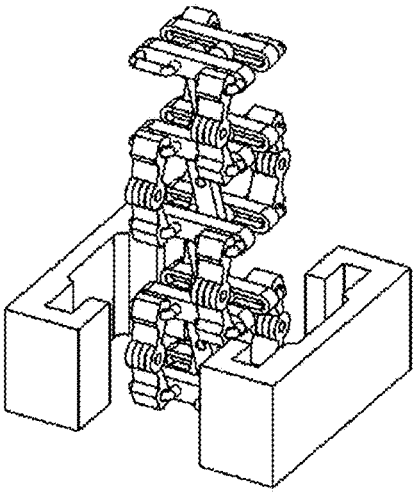
FIG. 17*a* is a schematic diagram of another embodiment of the track zipper of the present disclosure in an opened position.
Figure 17B:
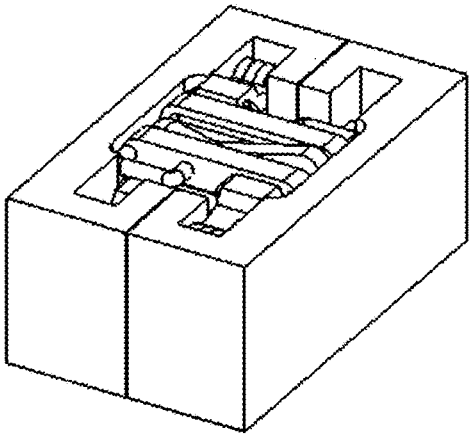
FIG. 17*b* is a schematic diagram of the track zipper shown in FIG. 17*a* in a closed position.
Figure 18A:
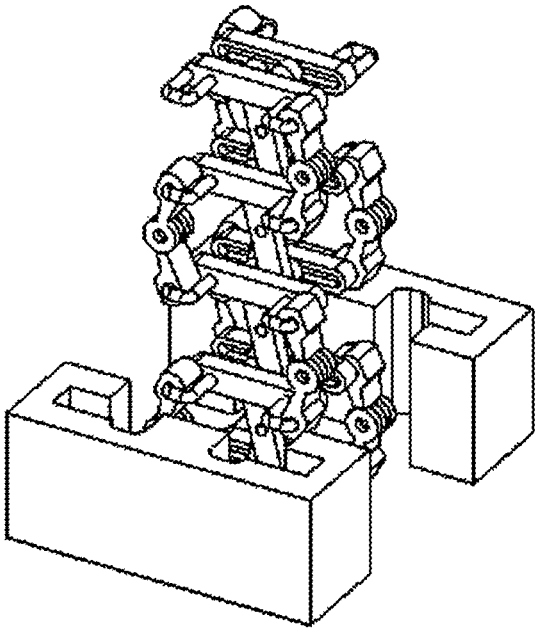
FIG. 18*a* is a schematic diagram of another embodiment of the track zipper of the present disclosure in an opened position.
Figure 18B:
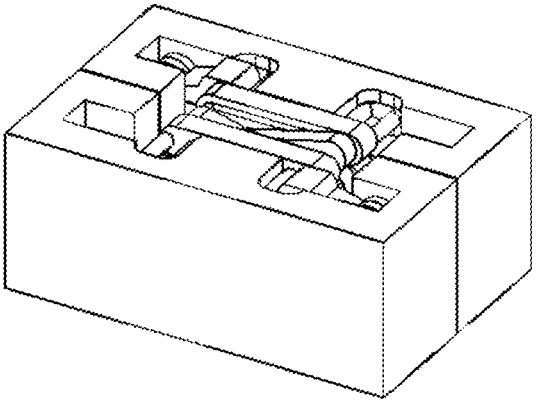
FIG. 18*b* is a schematic diagram of the track zipper shown in FIG. 18*a* in a closed position.

FIG. 15 shows another embodiment of the connecting structure of the present disclosure. This embodiment relates to a sail 7 of a windsurfing sailboard or a boat. One or more the track zippers of the present disclosure may be provided on the sail 7 to connect pieces of the sail together.

FIGS. 16*a* to 16*f* are schematic diagrams of another embodiment of the track zipper of the present disclosure. In this embodiment, the zipper core may adopt a modular core structure. The zipper core may have a three-layered structure. A middle layer can be moved up and down relative to the two outer layers. Due to the protrusion-recess structure of the layers, the thickness of the modular core can be changed. When the modular core has a maximum thickness, the protrusions of the outer layers engages with corresponding openings or grooves formed on the first and second tracks so as to close the track zipper. When the modular core has a minimum thickness, the zipper core can be pulled out from the first and second tracks to open the track zipper.

FIGS. 17*a*-17*b* and FIGS. 18*a*-18*b* are two other embodiments of the track zipper of the present disclosure. The track zipper may have a collapsible zipper core. The zipper core can be collapsed through a connecting rod structure. The zipper is opened when the zipper core is expanded, and the zipper is closed when the zipper core is collapsed.

Figures 19A, 19B:
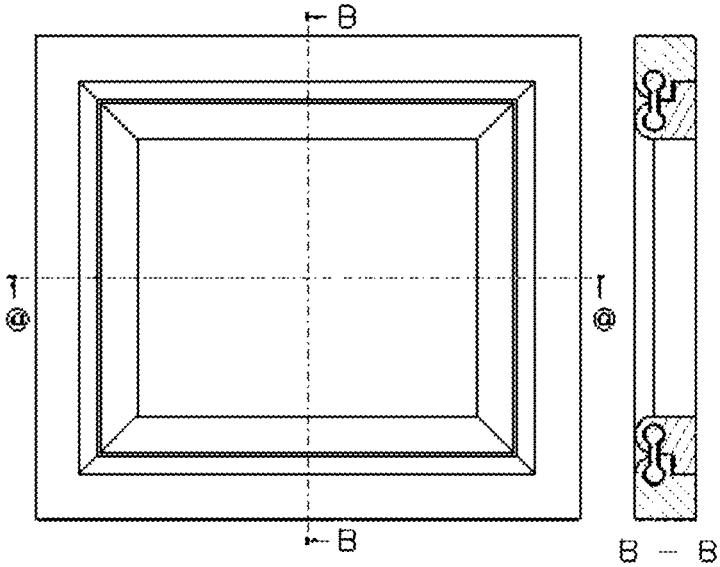
FIG. 19*a* is a schematic diagram of a window frame with the track zipper of the present disclosure.
FIG. 19*b* is a cross-sectional view at B-B in FIG. 19*a;*
Figure 19C:
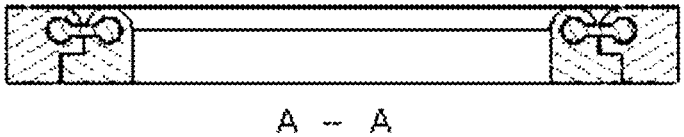
FIG. 19*c* is a cross-sectional view at A-A in FIG. 19*a;*
Figure 20:
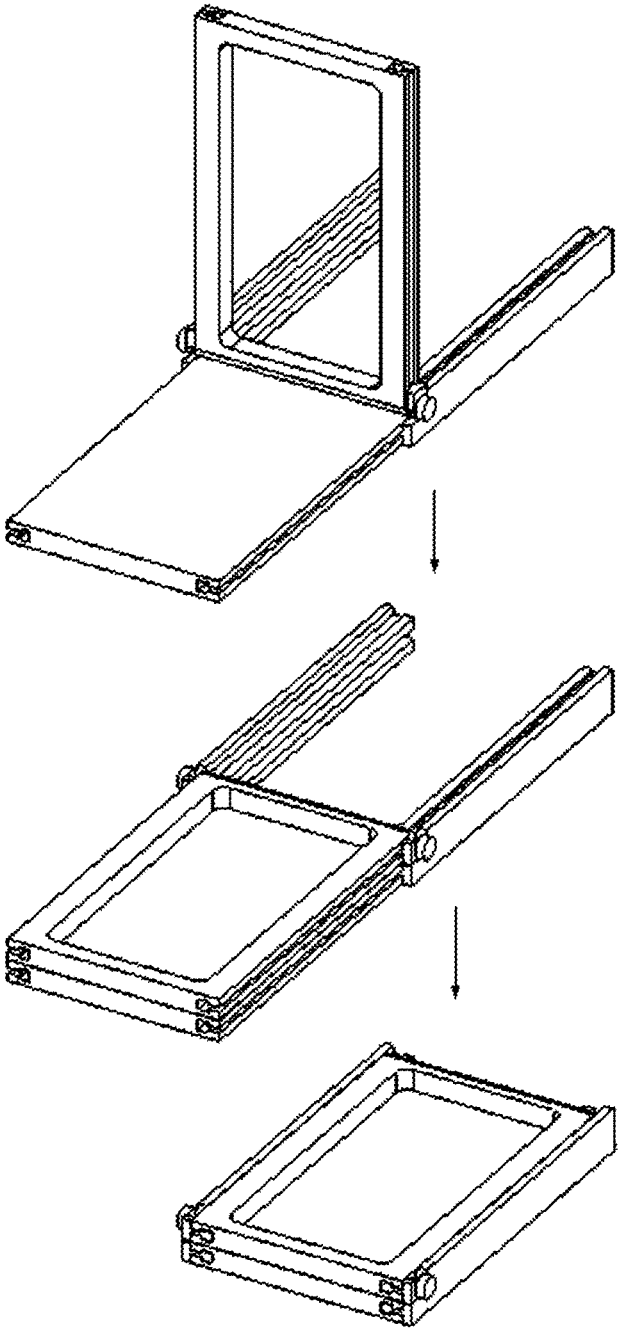
FIG. 20 is a schematic diagram of the track zipper of the present disclosure used for connecting a frame and a base plate.

FIGS. 19*a* to 19*c* are schematic diagrams of the track zipper of the present disclosure for connecting a window to a window frame. The position of the track zippers is arbitrary, and the track zippers can be installed in any other suitable locations. FIG. 20 shows a schematic diagram of using two track zippers to connect a frame to a base plate. In the top drawing, the frame is in an open position. Since the head portions of the zipper cores are inserted into the frame and the base plate, an upper half of the head portion of each zipper core can rotate with the frame simultaneously. In the middle drawing, the frame rotates anticlockwise until it rests on top of the base plate. In the bottom drawing, the track zippers are closed, and the frame cannot be opened.

Figure 21A:
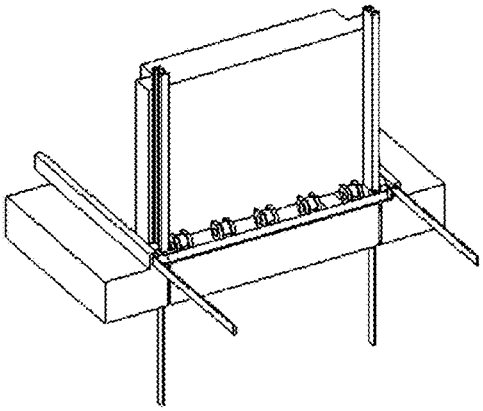
FIGS. 21*a*-21*d* are schematic diagrams of the track zipper of the present disclosure used for connecting a door or a cover.
Figure 21B:
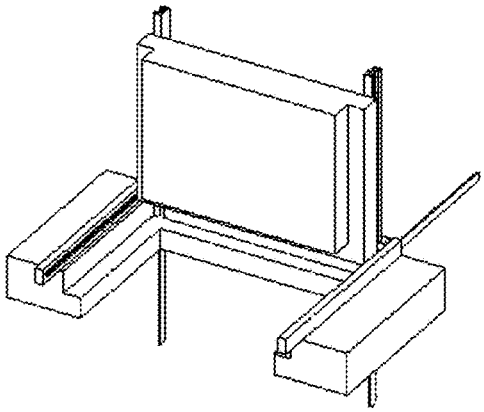
Figure 21C:
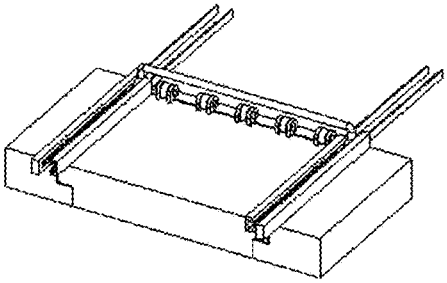
Figure 21D:
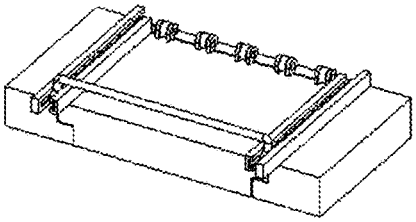
Figure 22A:
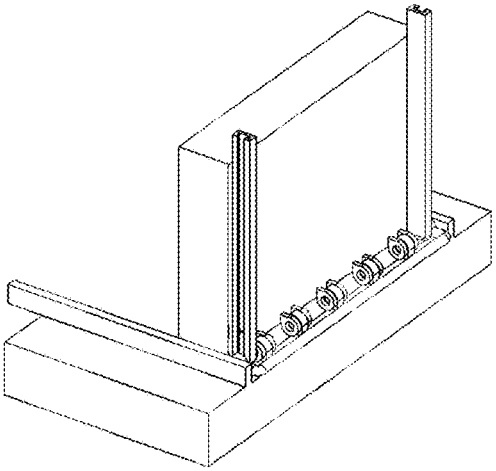
FIGS. 22*a*-22*c* are schematic diagrams of the track zipper of the present disclosure for use in a door-like structure.
Figure 22B:
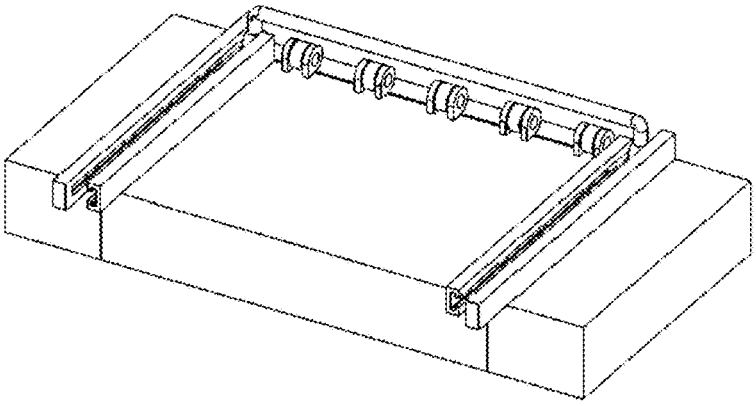
Figure 22C:
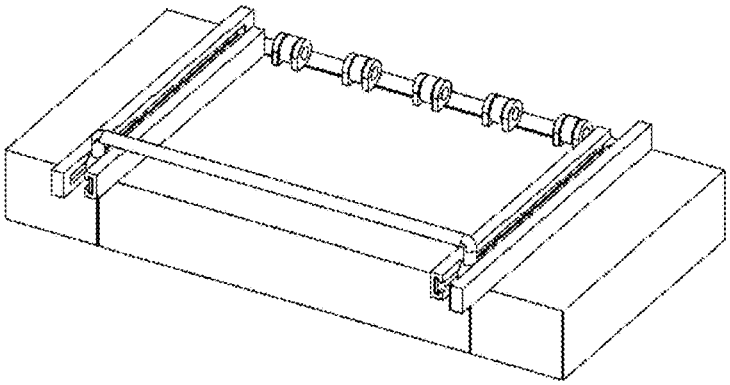

FIGS. 21*a* to 21*d* are schematic diagrams of the track zipper of the present disclosure used for connecting a door or a cover. In this embodiment, a movable part can be connected to a stationary part. It can be used for doors and covers, including hatch doors, and a variety of doors and covers in a house. When the zipper is closed, the door cannot be opened. FIGS. 21*a* and 21*b* are different views of the same structure. As shown in FIG. 21*c*, the middle portion (i.e., the door or cover) can be rotated anticlockwise until it is closed. As shown in FIG. 21*d* the two zipper cores are pulled forwards so that the door or cover cannot be opened. In order to pre-install the zipper cores in the channels, each zipper core can be split or combined, and can be rotated. FIGS. 22*a*-22*c* are the same as FIGS. 21*a*-21*d*, except that the zipper cores are shortened or concealed.

Figure 23A:
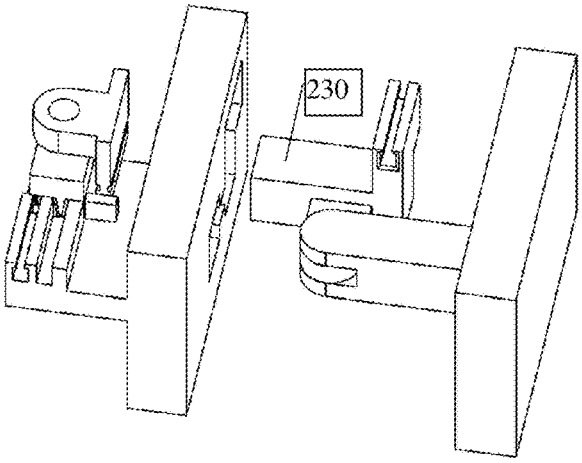
FIGS. 23*a*-23*b* are schematic diagrams of the track zipper of the present disclosure used for connecting a movable part and a stationary part.
Figure 23B:
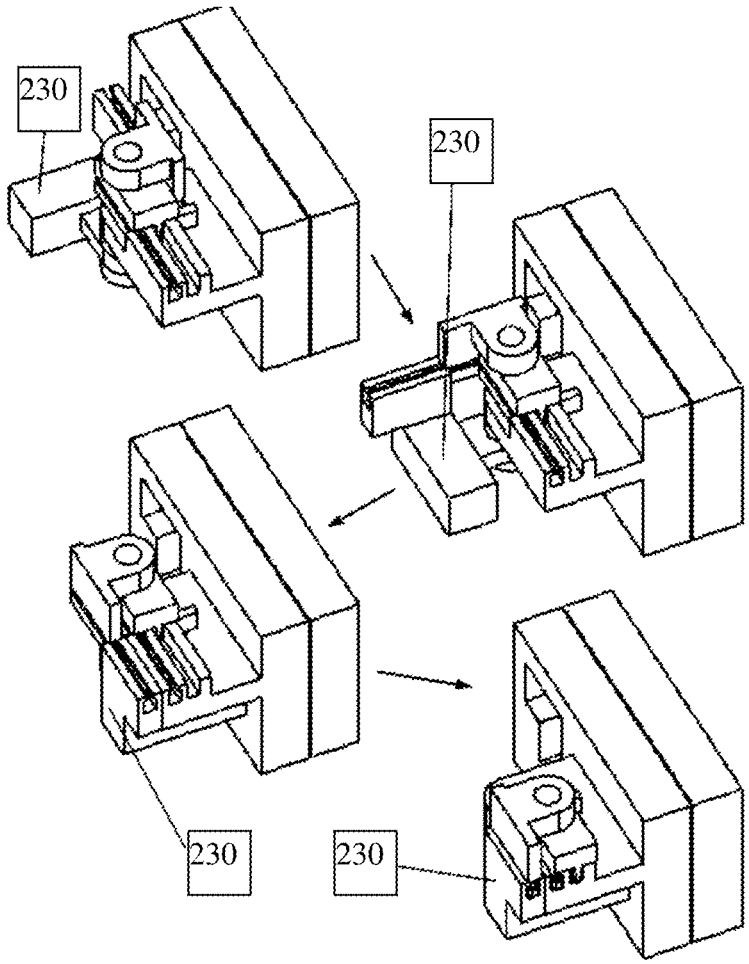

FIGS. 23*a* and 23*b* are schematic diagrams of the track zipper of the present disclosure used for the connection of a movable part and a stationary part. The right assembly on the right side of FIG. 23*a* penetrates into the left assembly on the left side of FIG. 23*a*, and can then form into the assembly shown in the first drawing in FIG. 23*b*. After two 90 degree rotations, the assembly becomes the assembly shown in the third drawings in FIG. 23*b*. The last drawing in FIG. 23*b* shows the assembly after pulling of the zipper core. Before the track zipper is opened, an abutment 230 of the right assembly continues to abut against the left assembly.

Figure 24A:
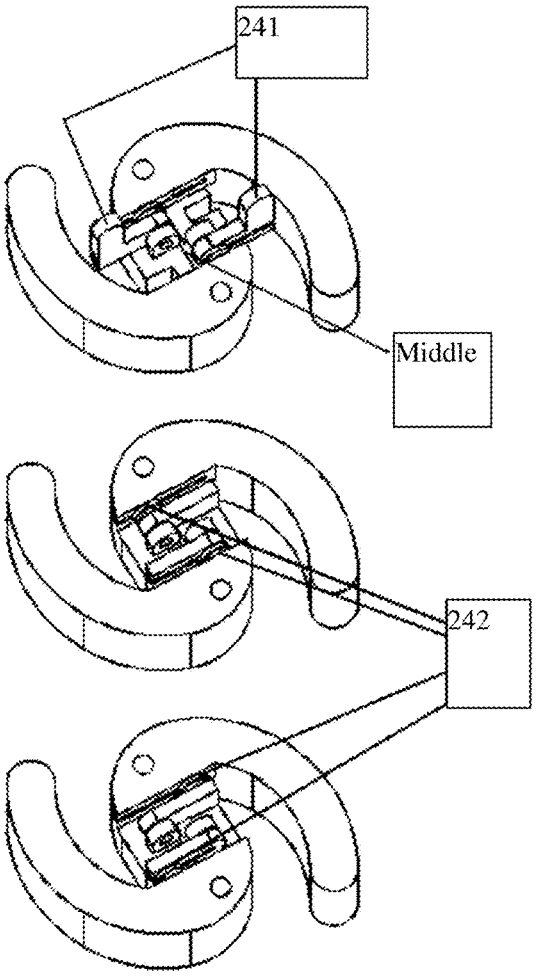
FIGS. 24*a*-24*c* are schematic diagrams of the track zipper of the present disclosure for use in an automatic hook.
Figure 24B:
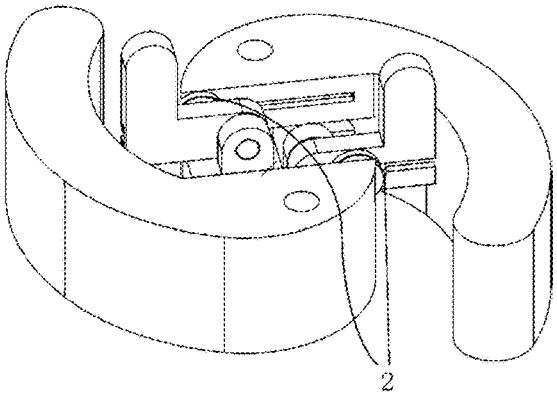
Figure 24C:
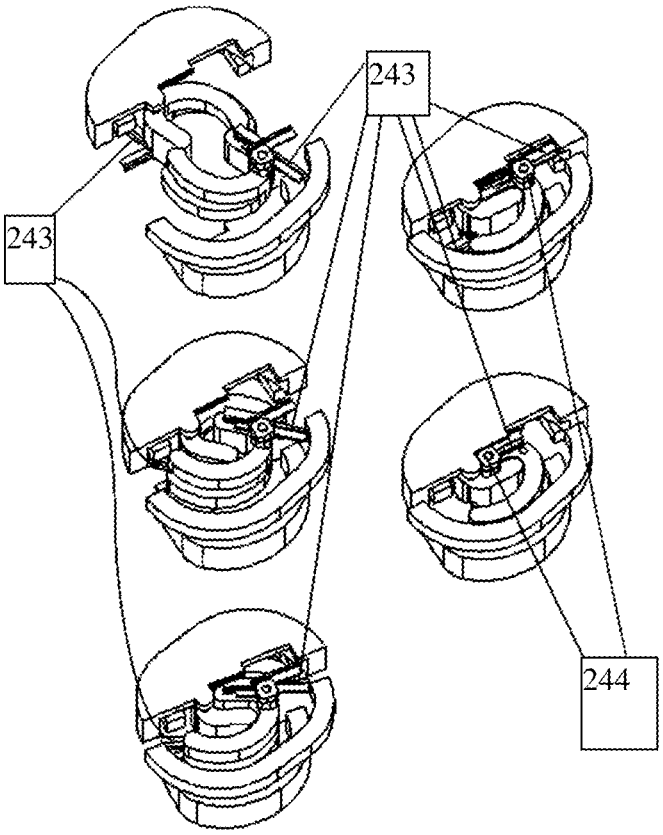

FIGS. 24*a* to 24*c* are schematic diagrams of the track zipper of the present disclosure for use in automatic connection hooks. Similar to the design of automatic hooks for train cars, when two train cars approach towards each other, two hooks will turn into an "S" combination. At this time, two "7" shaped hooks 241, as best illustrated in the top drawing of FIG. 24*a*, can be rotated 180 degrees to clasp onto each other, as shown in the middle drawing of FIG. 24*a*. After two track zippers 242 are closed, the "S" combination will be inseparable. When the track zippers 242 are pulled to the position shown in FIG. 24*b*, the two "7" shaped hooks cannot be rotated. FIG. 24*c* shows a design similar to the design of automatic hooks for train cars. The three drawings on the left side of FIG. 24*c* show the automatic hooks when two train cars are approaching. The upper drawing on the right side of FIG. 24*c* shows the hooks when the two train cars are stopped. The lower drawing on the right side of FIG. 24*c* shows the hooks after zipper cores 243 of track zippers 244 are pulled into the stationary parts on the other sides. The hooks are then inseparable.

Figure 25:
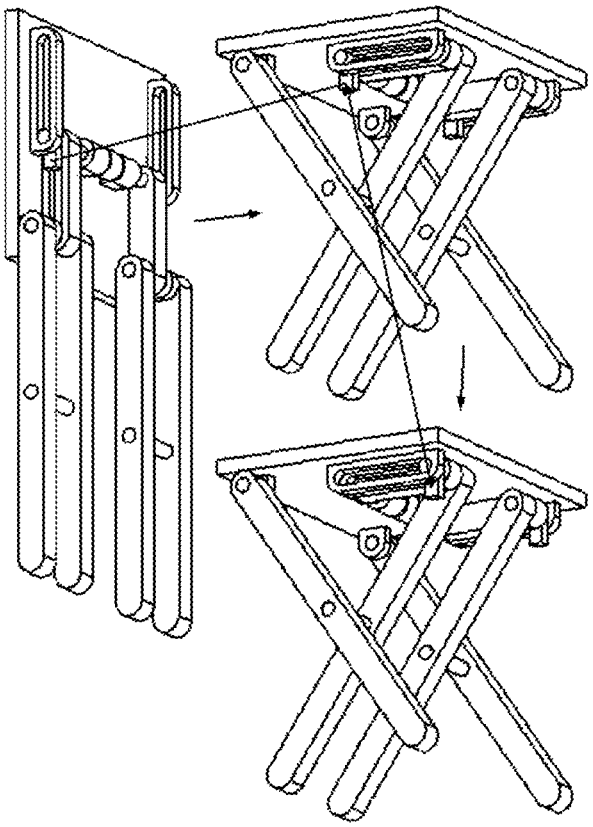
FIG. 25 is a schematic diagram of the track zipper of the present disclosure for use in a foldable chair.

FIG. 25 is a schematic diagram of the track zipper for use in a foldable chair. After the foldable chair is unfolded and the track zippers are pulled to a closed position, the unfolded chair cannot be folded up.

Figure 26:
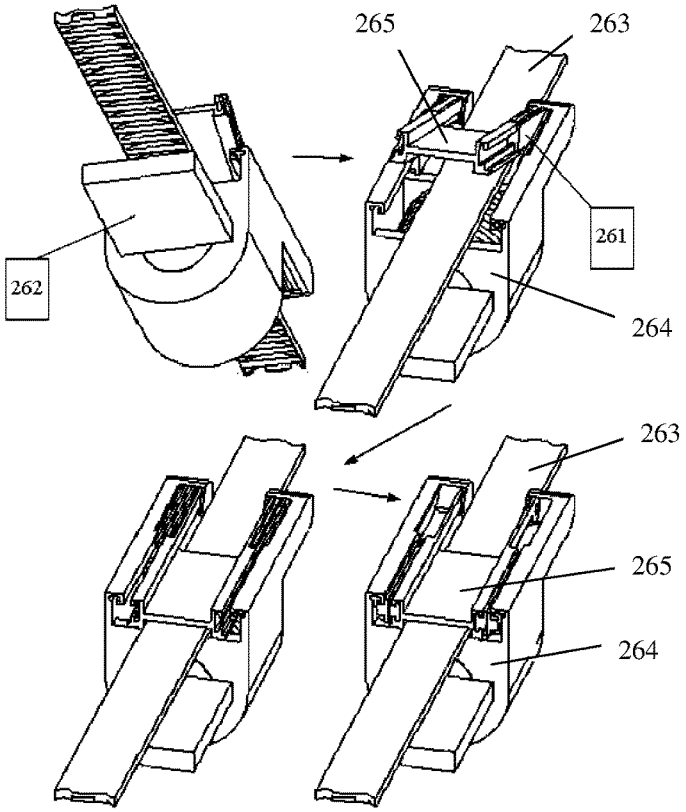
FIG. 26 is a schematic diagram of the track zipper of the present disclosure for use in a hose clamp.

FIG. 26 is a schematic diagram of the track zipper of the present disclosure for use in a hose clamp. The hose clamp can be a reusable hose clamp. The top two drawing are different views of the same hose clamp. When the track zippers are in an open position, a serrated band 263 can be moved along the direction of the casing, i.e. first casing 264 and second casing 265. The first and second casings may be moveable between an upfold position and a fold up position. After the serrated band is adjusted to a desired position, the serrated band will be locked by folding up the first and second casings. As shown in the bottom drawing on the left side of FIG. 26, the track zippers are in an open position. The track zippers can be closed by pulling zipper cores 261 into the corresponding tracks, as shown in the bottom drawing on the right side of FIG. 26. It is still possible to adjust its tightness by rotating a knob 262. This structure can be used in a wide range of applications, such as a reusable cable tie. It can also be used to adjust the angle of an aluminum window.

Figure 27:
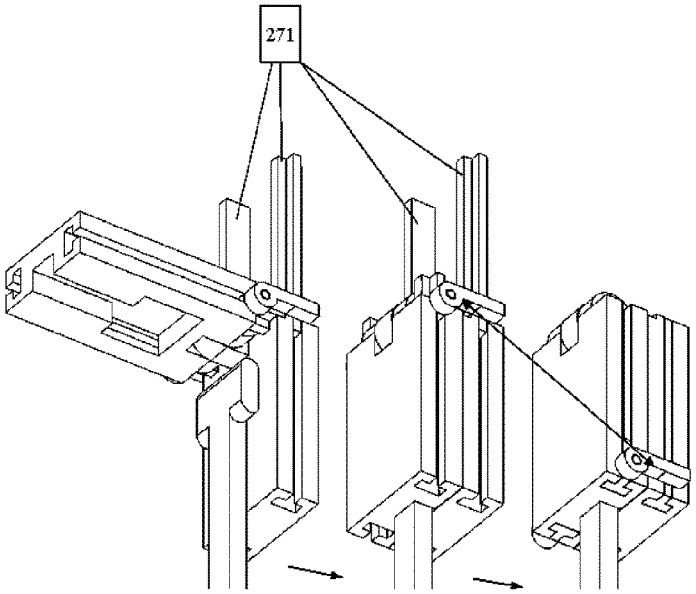
FIG. 27 is a schematic diagram of the track zipper of the present disclosure for use in a lock.

FIG. 27 is a schematic diagram of the track zipper of the present disclosure for use in a lock. The left drawing in FIG. 27 shows an opened cover. A "T" shaped object is put in a set position. The middle drawing shows that the cover is closed up. The right drawing shows that zipper cores 271 are pulled inside corresponding tracks so that the cover cannot be opened and the "T" shaped object is locked. This concept can be used for various types of locking mechanism. For example, a watch case can be locked onto a watch strap without providing watch lugs on the watch case.

Figure 28A:
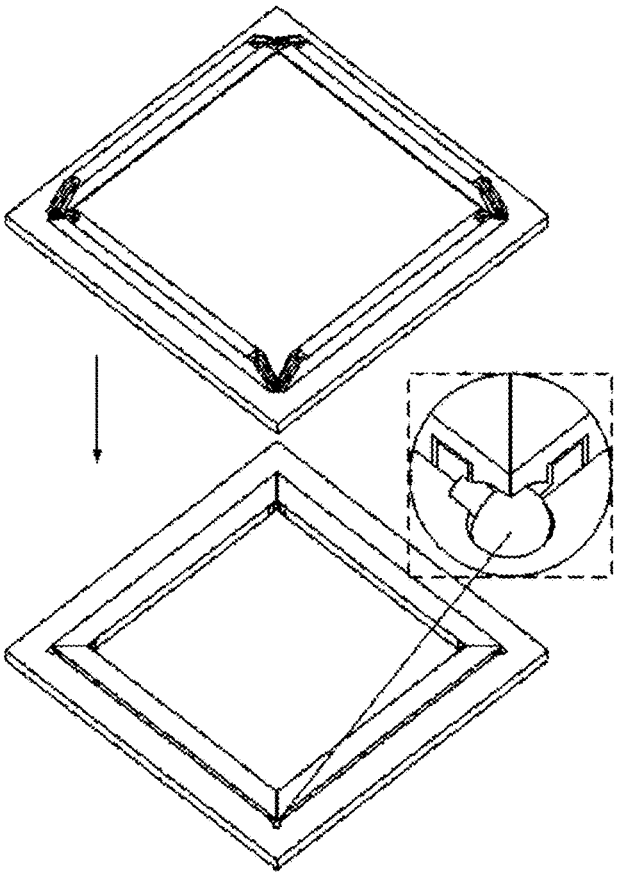
FIGS. 28*a*-28*b* are schematic diagrams of the track zipper of the present disclosure for use in a drawing frame or a mirror frame.
Figure 28B:
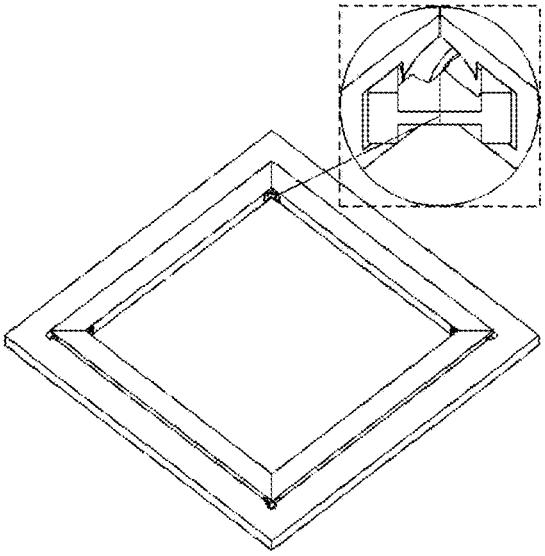

FIGS. 28*a* to 28*b* are schematic diagrams of the track zipper of the present disclosure for use in a picture frame or a mirror frame. The top drawing in FIG. 28*a* shows that a frame is in an open position, and the bottom drawing in FIG. 28*a* shows that the frame is in a closed position. If a picture or a mirror is placed in the frame, it will be pressed. The enlarged view shows that a universal hinge may be provided at each of the four corners of the frame. As shown in FIG. 28*b*, when the track zippers at the four corners of the frame are pulled inwards, the frame cannot be opened. A line/rope/ belt/cable may be provided, or a space for a handle may be provided to facilitate the completion of the action. It should be noted that the universal hinges are not necessary. Instead, ordinary hinges can be used. The only requirement is that these hinges need to be deeply hidden and attention should be paid when turning from vertical to horizontal position.

Specific embodiments have been described above with reference to the accompanying drawings. However, the present disclosure is not limited to the above specific embodiments. The above specific embodiments are merely illustrative and should not be considered as limiting. It should be noted that, upon reading the above disclosure, a person skilled in the art can make various other changes or modifications without departing from the scope of the appended claims.

What is claimed is:

1. A track zipper, comprising a first track; a second track; and a zipper core connecting the first and second tracks;

a first slidably connecting structure provided on the first track and a first side of the zipper core, the zipper core being slidable relative to the first track along a lengthwise direction thereof through the first slidably connecting structure, and the zipper core being inseparable from the first track in a direction perpendicular to the lengthwise direction of the first track;

a second slidably connecting structure provided on the second track and a second side of the zipper core, the zipper core being slidable relative to the second track along a lengthwise direction thereof through the second slidably connecting structure, and the zipper core being inseparable from the second track in a direction perpendicular to the lengthwise direction of the second track;

when the track zipper is in a closed position, the zipper core is provided between the first and second tracks, and connects the first and second tracks together;

wherein the first and second tracks are formed with hooks that are engageable with an enlarged upper end of the zipper core so that movement of the zipper core is restricted at a specific position; and wherein the enlarged upper end of the zipper core is formed with slanted surfaces, and the lower end of the first and second tracks is enlarged to facilitate insertion of the zipper core into the first and second tracks.

2. The track zipper according to claim 1, wherein the first slidably connecting structure comprises a first track groove formed on the first track; and a first track portion formed on the first side of the zipper core and mating with the first track groove, the first track portion of the zipper core being sheathed in the first track groove and slidable in the first track groove along an extending direction thereof, and inseparable from the first track groove in a direction perpendicular to the extending direction of the first track groove.

3. The track zipper according to claim 1, wherein the second slidably connecting structure comprises a second track groove formed on the second track; and a second track portion formed on the second side of the zipper core and mating with the second track groove, the second track portion of the zipper core being sheathed in the second track groove and slidable in the second track groove along an extending direction thereof, and inseparable from the second track groove in a direction perpendicular to the extending direction of the second track groove.

4. A connecting structure for a hose clamp comprising a first object; a second object; and the track zipper, as claimed in claim 1, for connecting the first and second objects, wherein the first track of the track zipper is connected with the first object, and the second track of the track zipper is connected with the second object.

5. The connecting structure for a hose clamp according to claim 4, wherein the first object and the second object are moveable between an unfold position and a fold up position, the first object and the second object are folded up to hold a third object, and the first object and the second object are in the fold up position when the track zipper is closed.

6. The connecting structure for a hose clamp according to claim 5, wherein the first object and the second object are a casing of the hose clamp, and the third object is a serrated band of the hose clamp.

* * * * *